US009612067B2

(12) United States Patent
BOYARKIN

(10) Patent No.: US 9,612,067 B2
(45) Date of Patent: Apr. 4, 2017

(54) AUTOMATIC WEAPON WITH A COMBINED SYSTEM OF USE (ALTERNATIVES)

(71) Applicants: Federal State Budgetary Institution « Federal Agency for Legal Protection of Military, Special and Dual Use Intellectual Activity Results» (FSBI « FALPIAR. ), Moscow (RU); Vitali Vitalevich BOYARKIN, Irkutsk (RU)

(72) Inventor: Vitali Vitalevich BOYARKIN, Irkutsk (RU)

(73) Assignees: FSBI-FALPIAR, Moscow (RU); Vitali Vitalevich BOYARKIN, Irkutsk (RU)

( * ) Notice: Subject to any disclaimer, the term of this patent is extended or adjusted under 35 U.S.C. 154(b) by 13 days.

(21) Appl. No.: 14/485,730

(22) Filed: Sep. 14, 2014

(65) Prior Publication Data

US 2015/0267977 A1 Sep. 24, 2015

Related U.S. Application Data

(63) Continuation of application No. PCT/RU2012/000571, filed on Oct. 25, 2012.

(30) Foreign Application Priority Data

Mar. 13, 2012 (RU) ..... 2012109555

(51) Int. Cl.
*F41C 23/04* (2006.01)
*F41A 5/18* (2006.01)
(Continued)

(52) U.S. Cl.
CPC *F41A 5/18* (2013.01); *F41A 9/61* (2013.01); *F41A 17/38* (2013.01); *F41A 19/09* (2013.01);
(Continued)

(58) Field of Classification Search
None
See application file for complete search history.

(56) References Cited

U.S. PATENT DOCUMENTS 4,735,007 A * 4/1988 Gal ..... F41C 23/04 42/7
2003/0116008 A1 6/2003 Koursakoff
(Continued)

FOREIGN PATENT DOCUMENTS

| | | |
|---|---|---|
| EA | 000020 | 12/1997 |
| EA | 200501637 | 10/2006 |
| RU | 2072496 | 1/1997 |

*Primary Examiner* — Stephen M Johnson
(74) *Attorney, Agent, or Firm* — Andrew W. Chu; Craft Chu PLLC

(57) ABSTRACT

An automatic handgun has an additional trigger mechanism and a sight. In one version, a draw bar in the butt is hinged to a rotatable fork and to the additional trigger, located on the left of the butt in an L-shaped groove. Upon rotating the fork the spring extends onto the left of the butt, and when the butt is closed onto a catch, the end of the fork grips the main trigger. Rotatable posts lie on the sight. Alternatively, a rotatable lever sits on the lower front of the breech. The lever has a post on which the additional trigger which fixes the horizontal and vertical positions is hinged, and is connected to the main trigger by a draw bar through the inside left of the breech. Shooting accuracy increases and the overall dimensions are reduced.

2 Claims, 31 Drawing Sheets

(51) Int. Cl.

| | |
|---|---|
| ***F41A 19/09*** | (2006.01) |
| ***F41G 1/02*** | (2006.01) |
| ***F41G 1/16*** | (2006.01) |
| ***F41A 17/38*** | (2006.01) |
| ***F41A 9/61*** | (2006.01) |
| ***F41C 7/00*** | (2006.01) |

(52) U.S. Cl.
CPC ..... *F41C 7/00* (2013.01); *F41C 23/04* (2013.01); *F41G 1/02* (2013.01); *F41G 1/16* (2013.01)

(56) References Cited

U.S. PATENT DOCUMENTS

| | | | | |
|---|---|---|---|---|
| 2004/0226213 | A1* | 11/2004 | Woodbury | F41G 1/033 42/140 |
| 2006/0242880 | A1* | 11/2006 | Griffin | F41C 23/04 42/73 |
| 2012/0137561 | A1* | 6/2012 | Ludlow | F41C 23/04 42/75.03 |

* cited by examiner

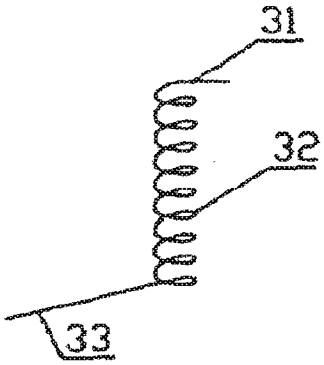
Fig. 12a
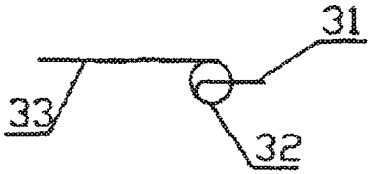
Fig. 12b
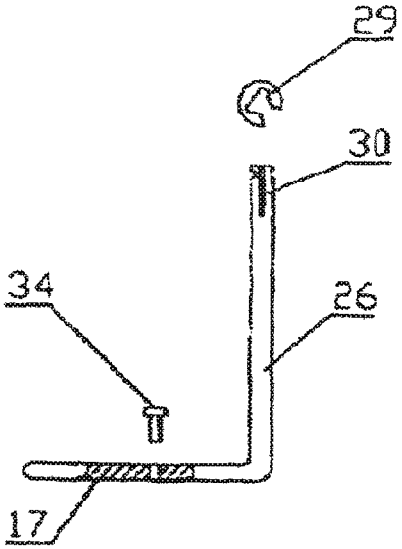
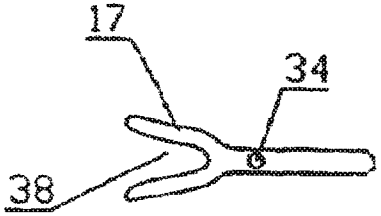

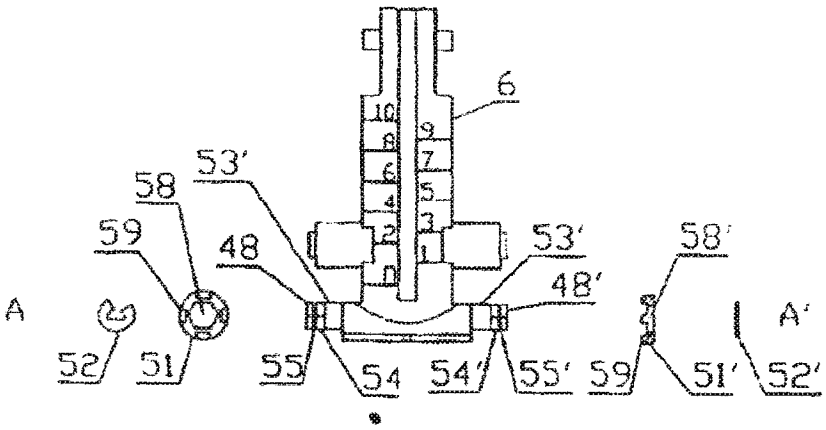
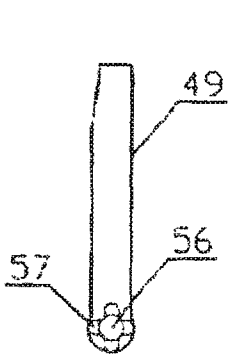
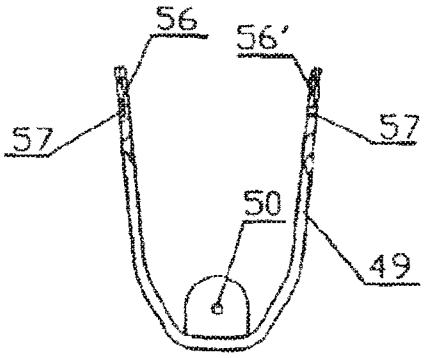
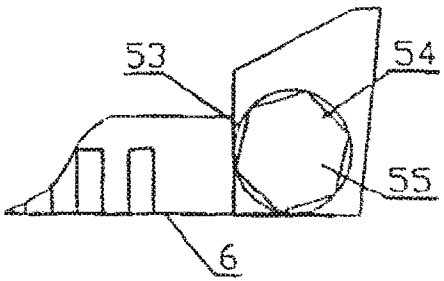
Fig. 18e
Fig. 18f
Fig. 18g

AUTOMATIC WEAPON WITH A COMBINED SYSTEM OF USE (ALTERNATIVES)

RELATED APPLICATIONS

This application is a continuation of PCT Patent Application No. PCT/RU2012/000571 having International Filing Date of Oct. 25, 2012, which claims the benefit of priority of Russian Patent Application No. 2012109555 filed on Mar. 13, 2012. The contents of the above applications are all incorporated herein by reference as if fully set forth herein in their entirety.

FIELD AND BACKGROUND OF THE INVENTION

The invention relates to small weapon and may be used in the military equipment. Automatic rifles are known that are made under the "classic" system, with a permanent or a folding butt and a fire control handle located between the butt and a magazine: http://worldwidewebdotgunsdotru/assault/rus/ak-74-rdothtml.

A drawback of the "classic" system is a great length of weapon and lowered grouping pattern during automatic shooting (for weapon where the barrel axis is higher than the butt axis).

Assault rifles are known that are made under the "bullpup" system, where the fire control handle with the trigger is located on the forearm:
http://worldwidewebdotgunsdotru/assault/rus/ots-14-groza-rdothtml;
http://worldwidewebdotgunsdotru/assault/isr/tavor-tar-21-rdothtml;
http://worldwidewebdotgunsdotru/assault/ua/verp-rdothtml;
http://worldwidewebdotgunsdotru/assault/ch/type-95--qbs-95-rdothtml.

This system is disadvantageous in that the weapon center of gravity is shifted to the rear portion, reloading and the use of the safety catch are not convenient, a butt is missing which is necessary when prone shooting and in a hand-to-hand fight. The closest analogous solution to the claimed one is "Automatic Weapon "Kalashnikov Assault Rifle" (Eurasian Patent No. 000020; AK-74M) that comprises a breech, a trigger mechanism (TM), a locking mechanism, a gas outlet mechanism, a folding butt with retainers for the fight and the transportation positions, a barrel with a sight block, a sight bar and a foresight post, a magazine, a magazine catch, a fire control handle.

AK-74M assault rifle has a folding plastic hollow butt that folds to the left side and is retained by a catch.

AK-74M drawbacks are: a great length when the butt is put into the fight position, which causes quick tiredness of a rifleman during standing aimed shooting; a reduced maneuverability in constrained conditions; difficulties during aimed shooting in the transportation position with the folded butt; lowered grouping pattern due to misalignment of the barrel axis and a butt rest point on the shoulder; a significant increase of loading onto a rifleman when additional devices are used, such as silencers, tactical lights, optical sights, etc.

SUMMARY OF THE INVENTION

In order to eliminate the said drawbacks, it is proposed to combine the classic system with the bullpup system, with the possibility of using both system in one piece of weapon, which will enable to fire aimed shots in the transportation position, improve grouping pattern, reduce loading on the rifleman's hands, decrease the weapon dimensions for using in constrained conditions, make aiming easier when bullet-proof vests, helmets with a protective visor and voluminous winter clothes are used, and, at the same time, will enable to maintain the possibility of using the butt.

For this purpose weapon are provided with an additional trigger mechanism and sighting devices enabling to fire aimed shots both with the butt unfolded into the fight position, and with the butt folded into the transportation position, wherein activation (transfer of additional devices from the transportation position to the fight position for shooting in the "bullpup" position does not take more than 6-10 seconds.

Thus, according to the first embodiment, a raw bar is arranged within the butt, the draw bar being hingedly connected to a rotatable fork and to an additional trigger located on the left side of the butt next to the back plate in an L-shaped groove and, upon rotation of the fork under the action of a spring, extending out of the groove perpendicularly above the lateral surface of the butt by 1.5-2.5 centimeters, by 90° onto the left side of the butt, and when the butt is closed onto a catch, the divided end of the said fork grips the main trigger of the assault rifle, the additional trigger being moved to the operating position in front of a magazine under the end of the breech at a distance app. 2 centimeters.

Posts having a shape of rotatable components retained by springs are mounted onto standard sighting devices of AK-74M. A swing-aside aperture sight is mounted onto the sight of the sight block on two half-pins, and a rotatable post of an additional foresight is mounted onto a modified slide runner of the main foresight. A spring-loaded rotatable pad is mounted onto the magazine catch. Additional butt plates are mounted onto the butt and the butt catch that hold a rubber shock absorber. An elastic cover made of a porous material and intended for cheek rest and a gas shield made of a springy high-temperature film are mounted onto the lid of the breech, the gas shield being fixed to the lid lateral surface by a springy plate with a retainer, as provided with T-shaped rivets.

Thus, according to the second embodiment, a rotatable lever is mounted in the front lower part of the breech, in front of the magazine in a sector opening on the axis of the butt catch, the said lever having a post on which an additional trigger with a means for fixing the horizontal and vertical positions is hingedly mounted. The lever is connected to the main trigger by a draw bar passing through the inside of the breech along the left side, the additional trigger is protected by a removable additional trigger staple consisting of two hingedly connected parts that are moved apart by a spring, and additional sighting devices, the magazine catch, the rubber shock absorber, the cover of the breech lid and the gas shield are the same as in the first embodiment.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings:

FIG. 1 also shows the locking mechanism 301, gas outlet mechanism 302, sight bar 303, and additional butt plates 304, 305.

FIGS. 12*a* and 12*b* show the rotatable fork with a spring and a lock washer: a) left-side view, b) bottom view, according to the first embodiment.

FIGS. 17*a*, 17*b*, 17*c* and 7*d* show the magazine catch with the rotatable pad: a) left-side view, b) rear view, c) the catch without the rotatable pad, left-side view, d) the catch with the rotatable pad turned into the horizontal position, left-side view according to the first and the second embodiments.

FIGS. 18*a*, 18*b*, 18*c*, 18*d*, 18*e*, 18*f* and 18*g* show the additional aperture sight mounted onto the weapon sight block: a) left-side view in the horizontal position, b) left-side view in the vertical position, c) rear view, in the horizontal position, d) rear view in the vertical position, e) top view, in the disassembled state, f) the sight staple, left-side view, g) section along A-A of the sight block, left-side view, according to the first and the second embodiments.

DESCRIPTION OF SPECIFIC EMBODIMENTS OF THE INVENTION

Figure 1:
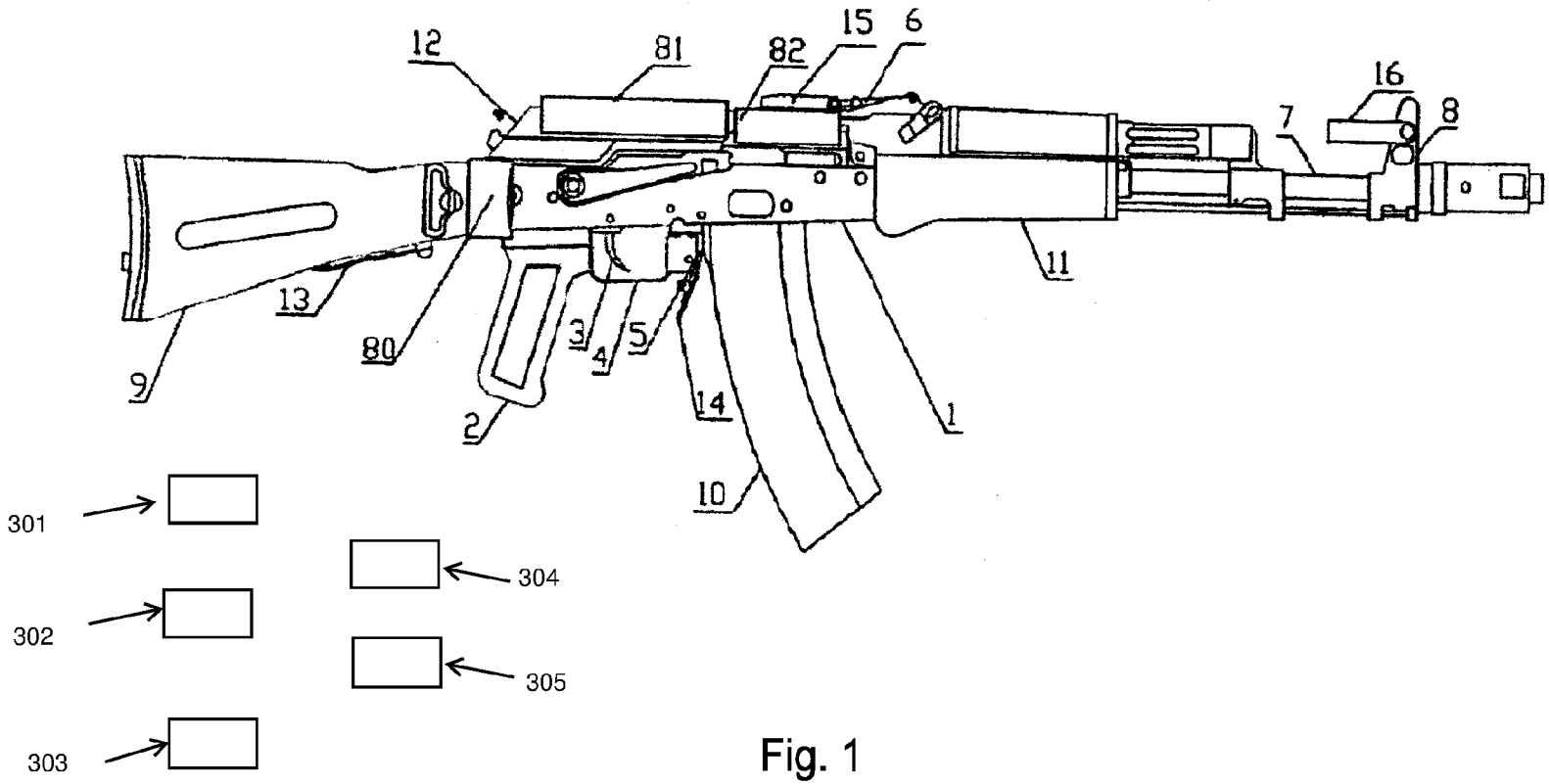
FIG. 1 shows a general view of the automatic weapon with a combined usage system, with the butt unfolded into the fight position, which is used in the "classic" system with additional devices folded into the inactivated state, according to the first embodiment, right-side view, partially in a cross-section.
Figure 2:
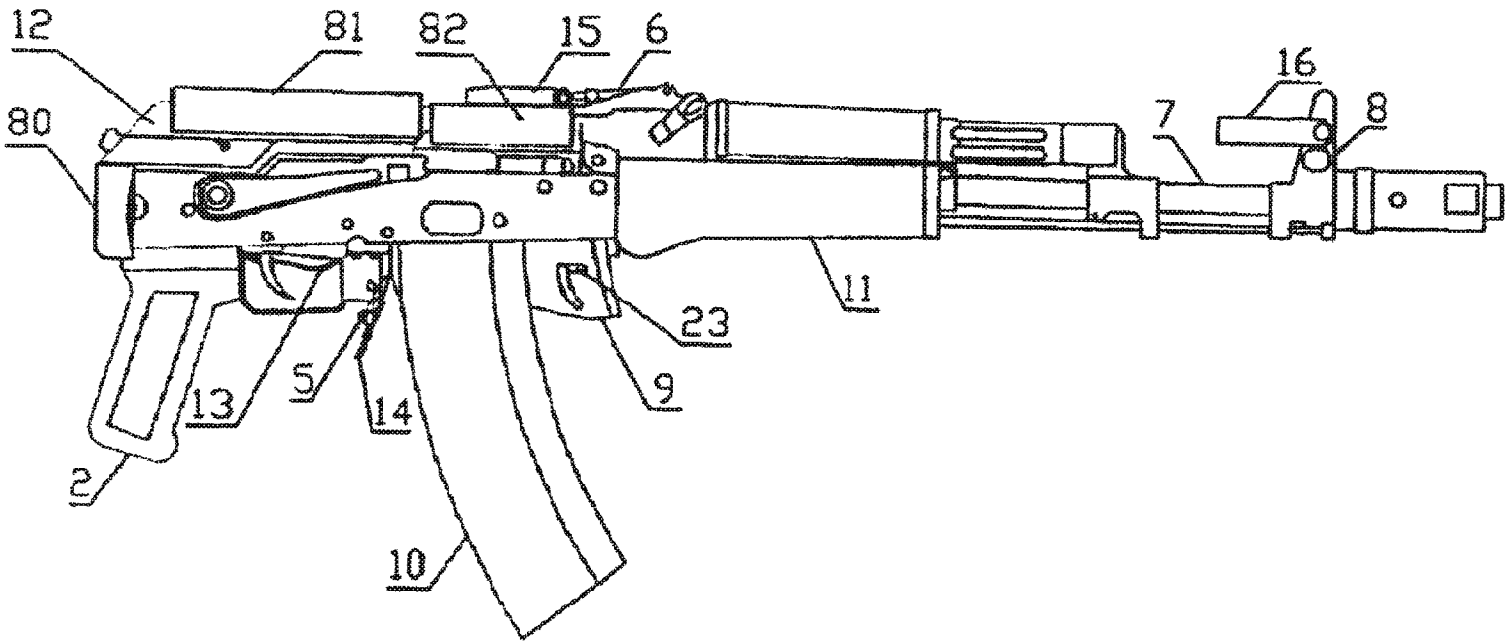
FIG. 2 shows a general view of the automatic weapon with the combined usage system, with the butt folded into the transportation position and additional devices folded into the inactivated state, according to the first embodiment, right-side view.
Figure 3:
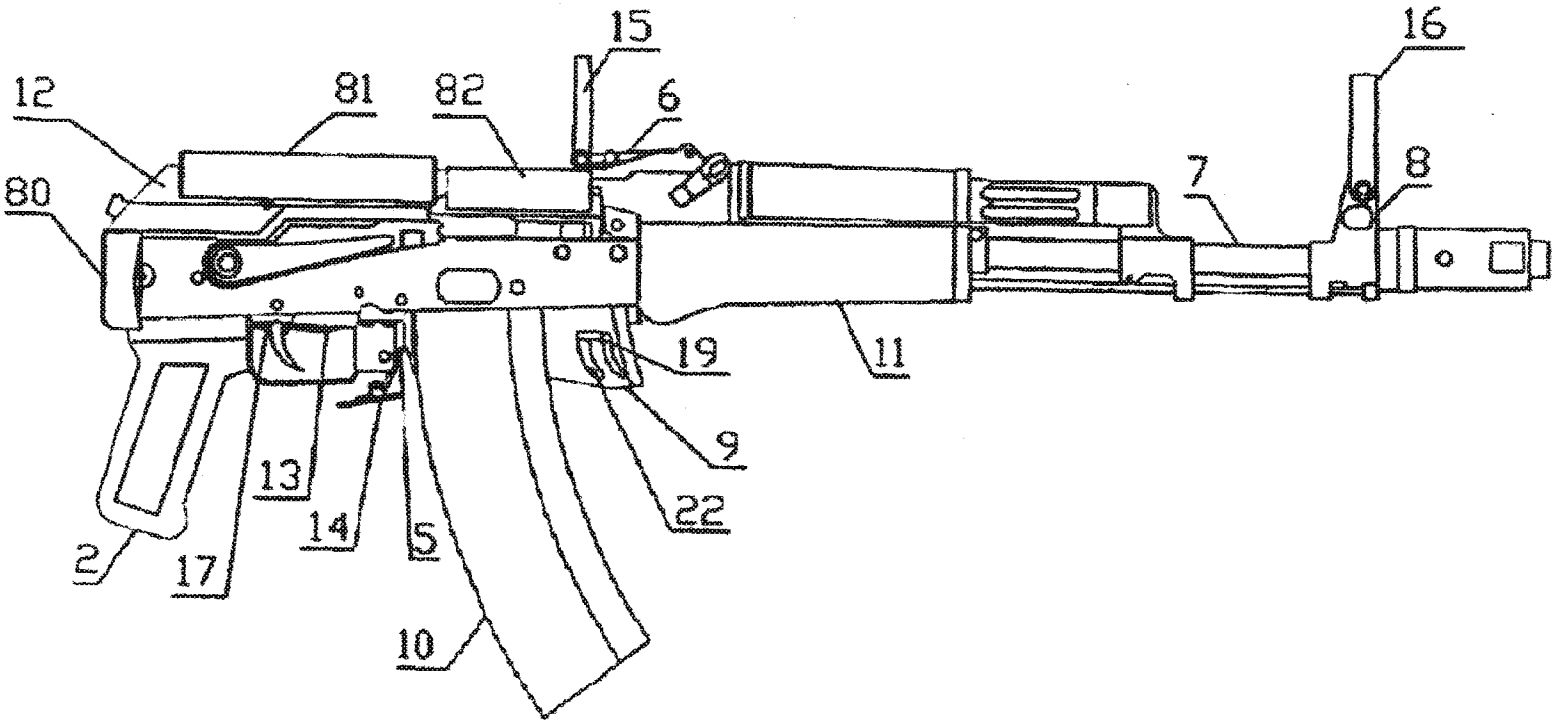
FIG. 3 shows a general view of the automatic weapon with the combined system of use, with the folded butt and the activated additional devices, according to the first embodiment, right-side view.

According to the first embodiment, the proposed automatic weapon with the combined system of use comprises all the main parts of the prototype (FIG. 1), namely: a breech (1) provided with a fire control handle (2), a trigger (3), a trigger staple (4), a magazine catch (5), a sight block (6); a barrel (7) with the foresight base (8); a folding butt (9); a magazine (10); a forearm (11); a breech lid (12). Furthermore, it is additionally provided with devices enabling to fire aimed shots according to "bullpup" system—with the butt folded and the breech back plate rested on the rifleman's shoulder. The additional devices do not interfere with the operation of the weapon main mechanisms.

The additional devices comprise: an additional trigger mechanism (13) arranged in the butt (9), a magazine catch rotatable pad (14), an aperture sight (15), an additional foresight rotatable post (16).

Figures 13A, 13B:
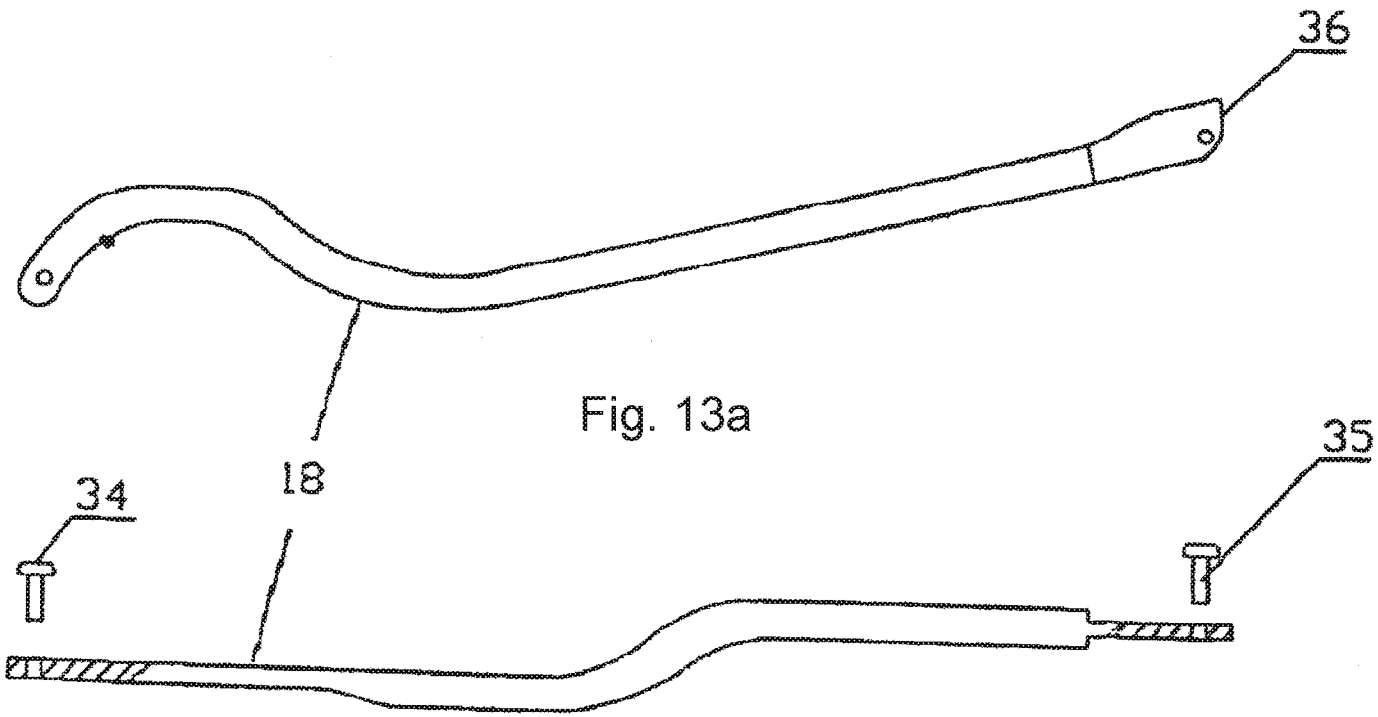
FIGS. 13*a* and 13*b* show the draw bar: a) bottom view, b) right-side view, according to the first embodiment.
Figure 14A:
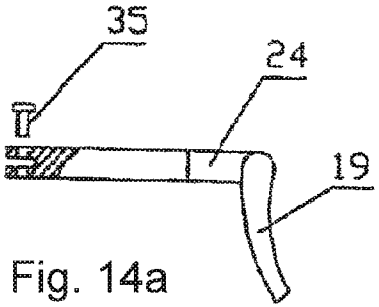
FIGS. 14*a* and 14*b* shows the additional trigger: a) right-side view, b) bottom view, according to the first embodiment.
Figure 14B:
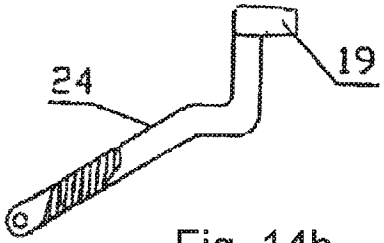
Figure 16:
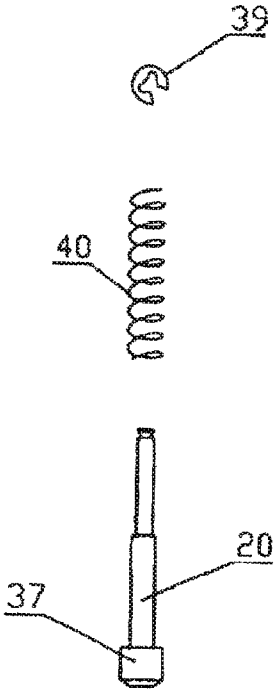
FIG. 16 shows the rotatable fork retainer with a spring and a lock washer, side view, according to the first embodiment.

The additional trigger mechanism (13) is arranged within the hollow butt (9) (FIGS. 1, 2, 3, 4, 5, 8, 9, 10, 11) and consists of a rotatable fork (17) (FIG. 12), a draw bar (18) (FIG. 13), an additional trigger (19) (FIG. 14) and a retainer (20) (FIG. 16) of the rotatable staple. The lower-side portion of the butt (9) is provided with a figured hole (21) for outputting the additional trigger (19) above the left-side surface, which hole has a curved lower part (22) corresponding to the trigger geometry and a part parallel to the lower portion of the breech and made as a groove (23) which size corresponds to the diameter of the trigger cylindrical portion (24). The butt lower portion is provided with an opening (25) through which the draw bar (18) leaves out. The pin (26) of the rotatable fork (17) is in holes (27), (28) and is fixed by a stop washer (29). The pin (26) is provided with a slot (30) wherein the end (31) of a torsion spring (32) is located. The second end (33) of the spring (32) rests against the inner surface of the butt (9). The fork (17) and the draw bar (18) are rotatably connected therebetween by the pin (34).

The trigger (19) is connected to the draw bar (18) by the pin (35). The end of the draw bar (18) has a stop (36) that restricts the possibility of its rotating around the trigger pin (35). The retainer (20) of the fork (17) (FIG. 16) is made as a cylindrical bar of variable diameter, which lower end is provided with a head (37) with a diameter slightly greater than the inner size of the groove (38) in the fork (17), and which upper end is provided with a slot for a stop washer (39). The retainer has a spring (40) resting against the upper inner surface of the butt and pushing the head (37) out of the hole (41).

Figure 15:
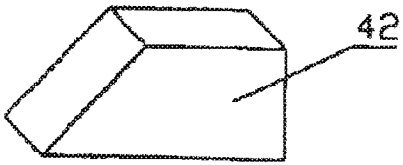
FIG. 15 shows the stop for the additional trigger, bottom view, according to the first embodiment.

In order to ensure the necessary height of the trigger (19) above the lateral surface of the butt (9), a stop (42) of the additional trigger, which is made as a wedge, is inserted into its lower portion (FIG. 15).

Figure 17A:
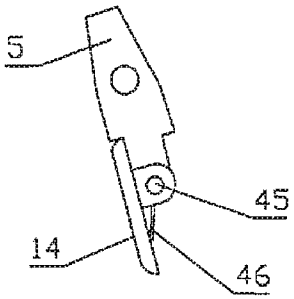
Figure 17B:
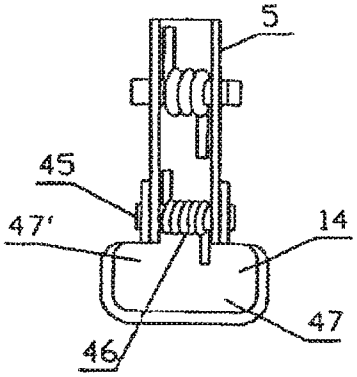
Figure 17C:
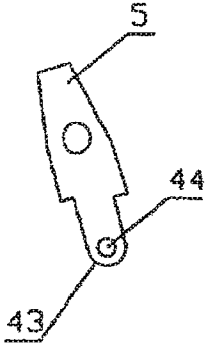
Figure 17D:
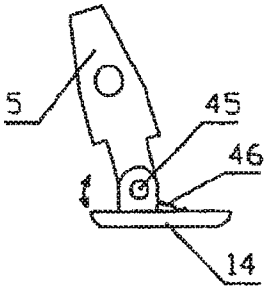
Figure 18C:
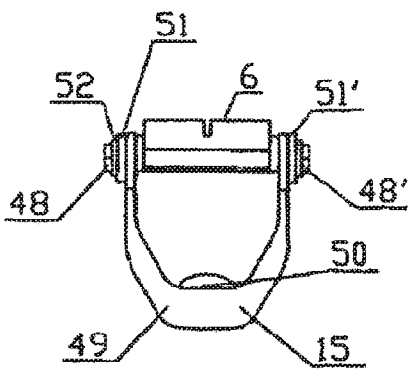
Figure 18D:
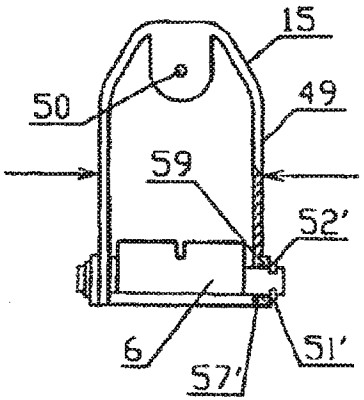
Figure 18A:
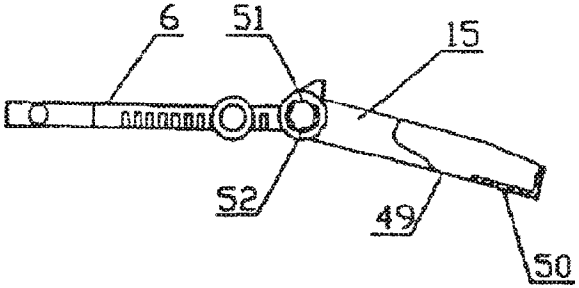
Figure 18B:
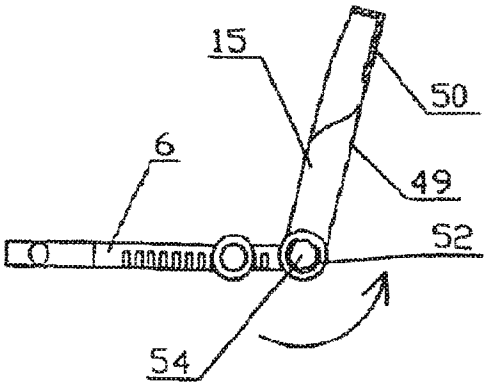

The rotatable pad (14) (FIG. 17) of the magazine catch is hingedly fixed on the magazine modified catch that differs from the standard one (FIG. 17*c*) by protrusions (43) with a hole (44) for a pin (45) of the rotatable pad on which a spring (46) is also arranged for pressing the rotatable pad (14) against the surface of the catch (5), which faces the magazine. The spring (46) is made not very rigid and enables to turn the pad (14) around the pin (45) easily. The pad (14) serves as a support for the upper surface of a rifleman's right hand (between the thumb and the index finger) when holding the weapon by the magazine while shooting with the use of the additional trigger (19). If the lower end of the pad (14) is pushed upwards, the pad moves aside by an angle at which its lower surface is parallel to the surface of the support (hand). After the hand moves from the magazine, the spring (46) will return the pad (14) to the vertical position. In this position the protruding edges (47, 47') enable to release the magazine by pressing on them with the index finger or the middle finger of the hand gripping the fire control handle (2). The pad (14) also enables to change the magazine in the usual way, i.e., by pressing on its lower portion with the thumb of the hand gripping the magazine.

The aperture sight (15) (FIG. 18 *a, b, c, d, e, f, g*) consists of the sight block (6) which rear sight lower portion contains half-pins (48, 48') made integral with the rear sight, staples (49) with an aperture sight (50), locking washers (51, 51') and stop washers (52, 52').

The half-pins (48, 48') have cylindrical portions (53, 53') resting against the rear sight, which ends turn into hexahedrons (54, 54') having slots (55, 55') for the stop washers (52, 52').

The staple (49), which is made of spring steel, has a pad with the aperture sight in its middle portion, and holes (56, 56') corresponding to the diameter of the cylindrical portions (53, 53') of the half-pins (48, 48') in its ends. Grooves (57,57') are made on the external sides of the staple (49) perpendicularly to the axis of the holes (56), the grooves being made to a half-depth of the staple (49) thickness in the shape of a cross or another figure having rotational symmetry of 90°.

The locking washers (51, 51') have hexagonal holes (58, 58') corresponding to the hexahedrons (54, 54') of the half-pins (48, 48'). One of the washer sides is provided with protrusions (59) located according to the shape of a cross and protruding above the washer surface by the size of the grooves (57, 57') of the staple (49). The dimensions of the protrusions (59) correspond to the dimensions of the grooves (57, 57') of the staple (49) and, when overlaid, firmly enter into each other, thus forming a tooth coupling.

The cylindrical portions (53, 53') have the length equal to the thickness of the staple (49) and that of the protrusions (59) of the washers, and the hexahedrons (54, 54') have the dimensions corresponding to the thickness of the locking washers (51, 51') (not metering the protrusions (59)). The working length of the hexahedrons (54, 54') is limited by the slots (55,55') for the locking washers (52, 52').

The ends of the staple (49) are not parallel to each other in the free state and slightly diverge due to elasticity of tits material. For installing on the half-pins (48, 48') the ends of the staple (49) are pulled apart and put on the ends of the half-pins (48, 48'). Then the ends of the staple (49) are clenched. The locking washers (51, 51') are put on the hexahedrons (54, 54') with the protrusions (59) facing the grooves (57, 57') in the mirror symmetry to each other and are fixed in the slots (55, 55') with the use of the locking washers (52, 52').

When the ends of the staple are clenched and the staple is turned by 90° relative to the plane of the sight block (6), the staple (49) takes a position in which the arrangement of its grooves (57, 57') corresponds to the protrusions (59) of the locking washers (51, 51'), and, due to elasticity of the staple material, the grooves (57,57') on its ends engage with the protrusions (59) of the washers (51, 51'). This also helps to eliminate any backlashes, and the staple (49) is locked on the half-pins (48, 48') without the possibility of rotating. And the aperture sight (50) is installed vertically in the fixed position over the sight block, which position enables to aim through it when the weapon are in the "bullpup" position or through the rear sight of the sight block (6) when the classic system of the weapon is used, without interfering with each other. In order to put the aperture sight (15) into the inactivated state, the ends of the staple (49) are pressed until they are disengaged from the grooves (57, 57') in the protrusions (59) of the washers (51, 51') (FIG. 17*d*, when the ends of the staple (49) are pressed as shown by the arrows), and the staple (49) is turned downward, to the lid of the breech until a click, to the position in which the grooves (57,57') engage with the protrusions (59) of the washers, when the turning angle is equal to 90°. In order to put the aperture sight into the activated state, the whole procedure is reversed.

Figure 19A:
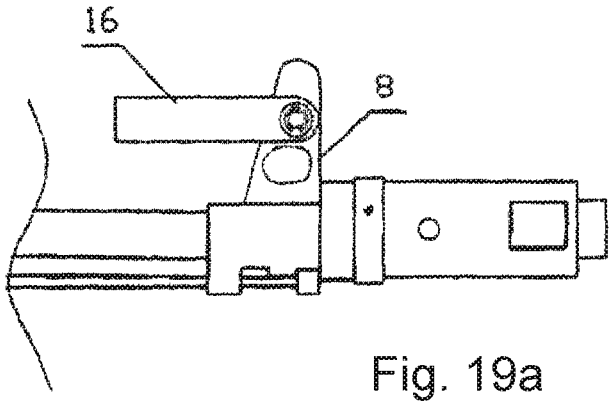
FIGS. 19*a* and 19*b* show the rotatable post of the additional foresight on the weapon, a) right-side view, in the inactivated state, b) right-side view in the activated state, according to the first and the second embodiments.
Figure 19B:
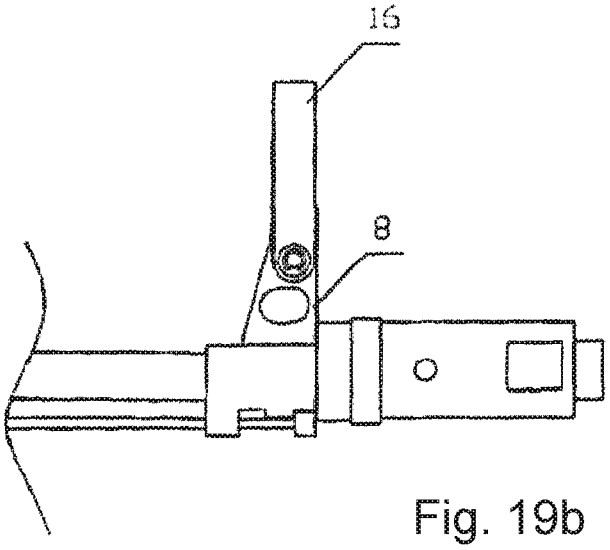
Figure 20:
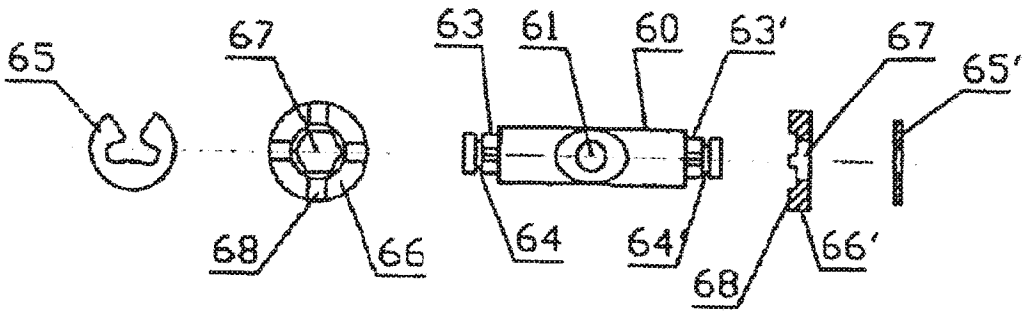
FIG. 20 shows the axis (modified slide runner of the main foresight) of the rotatable post of the additional foresight, with retaining and stop washers, top view, according to the first and the second embodiments.

The rotatable post of the additional foresight (16) (FIGS. 19 *a, b*; 20, 21, 22, 23) has a pin (60) (a modified slide runner of the main foresight, with a threaded hole (61) for attaching the main foresight (62) of the weapon), which ends, similarly to the structure of the aperture sight (15), have hexahedrons (63, 63'), slots (64, 64') and locking washers (65, 65'). Locking washers (66, 66') are put onto the hexahedrons (63,63'), the washers (66, 66') have hexagonal holes (67) and cross-shaped protrusions (68) protruding above the surface of the washers (66, 66') by a half of the thickness of a staple (69) of the rotatable post (16).

Figure 21B:
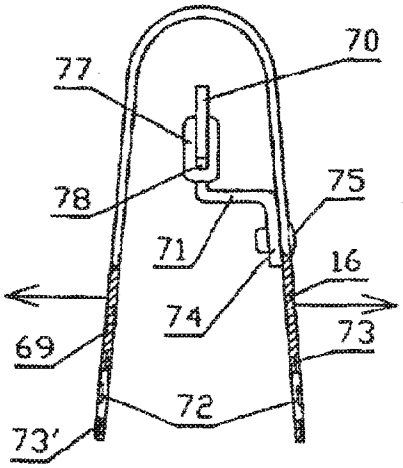
FIGS. 21*a* and 21*b* show the staple of the additional foresight rotatable post with a bracket installed therein, the bracket being provided with an additional foresight: a) left-side view, in a cross-section, b) front view, in a cross-section, according to the first and the second embodiments.
Figure 21A:
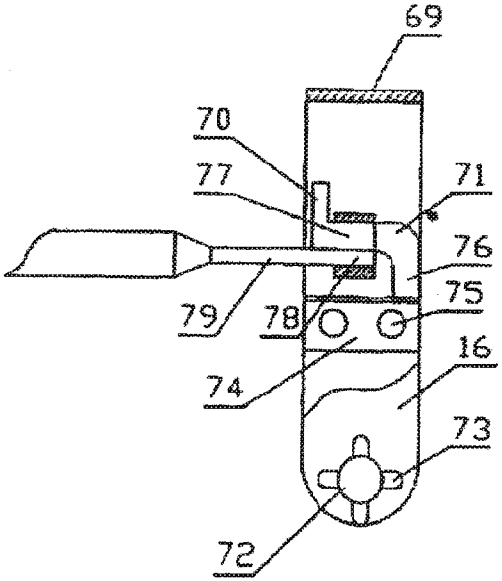

The staple (69) is made of spring steel, and its ends are not parallel to each other in the free state, but form an angle (FIG. 21 *b*).

An additional foresight (70) is fixed to the side of the staple (69) with the use of a bracket (71).

The ends of the staple (69) are provided with holes (72) corresponding to the diameter of the pin (60). Cross-shaped grooves (73, 73') are made on the external surface of the ends of the staple (69), around the holes (72), the dimensions of the grooves coincide with the dimensions of the protrusions (68) of the locking washers (66, 66'), thus forming a tooth coupling.

Figure 22:
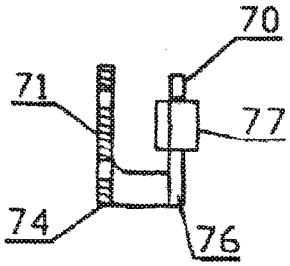
FIG. 22 shows the bracket of the additional foresight in the assembled state, top view, according to the first and the second embodiments.
Figure 23:
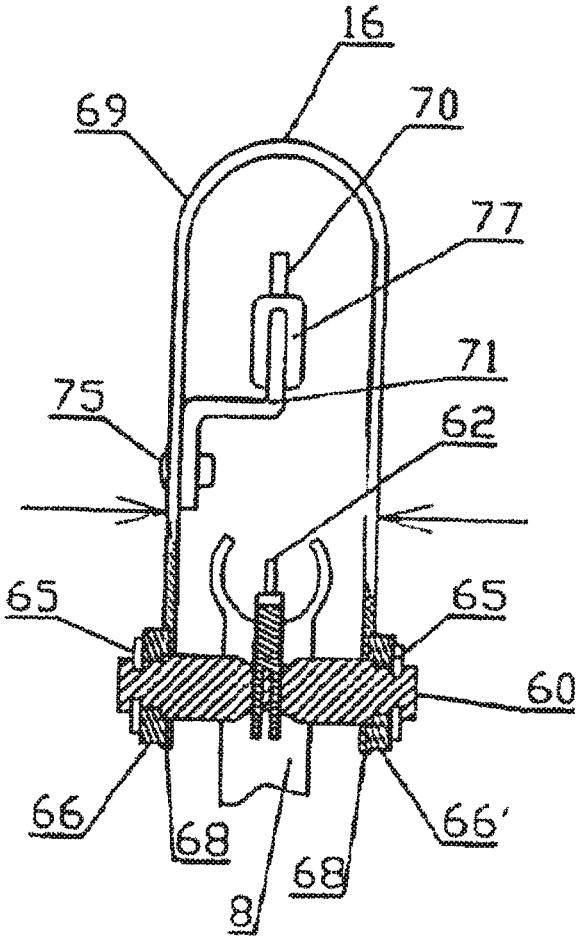
FIG. 23 shows the rotatable post of the additional foresight in the assembled state on the main foresight post, rear view, in a cross-section, according to the first and the second embodiments.
Figure 24A:
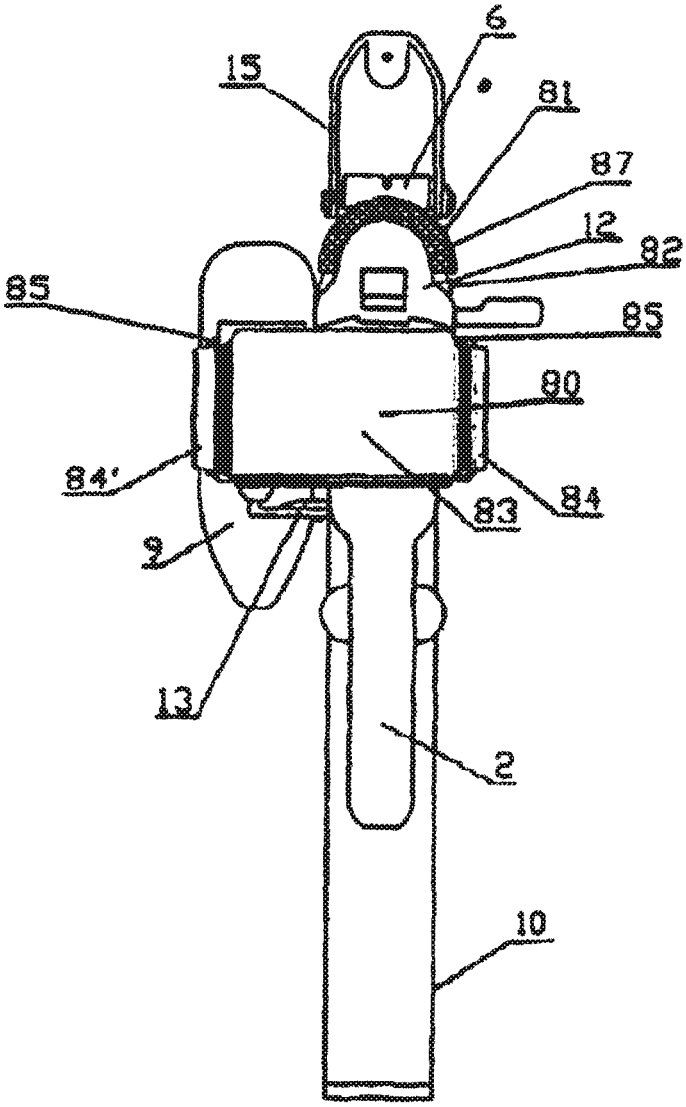
FIGS. 24*a* and 24*b* show the rubber shock absorber of the breech back plate, the cover for the breech and the gas shield: a) rear view, with the butt folded; b) top view with the butt folded, according to the first embodiment (the same parts are used in the second embodiment also).
Figure 24B:
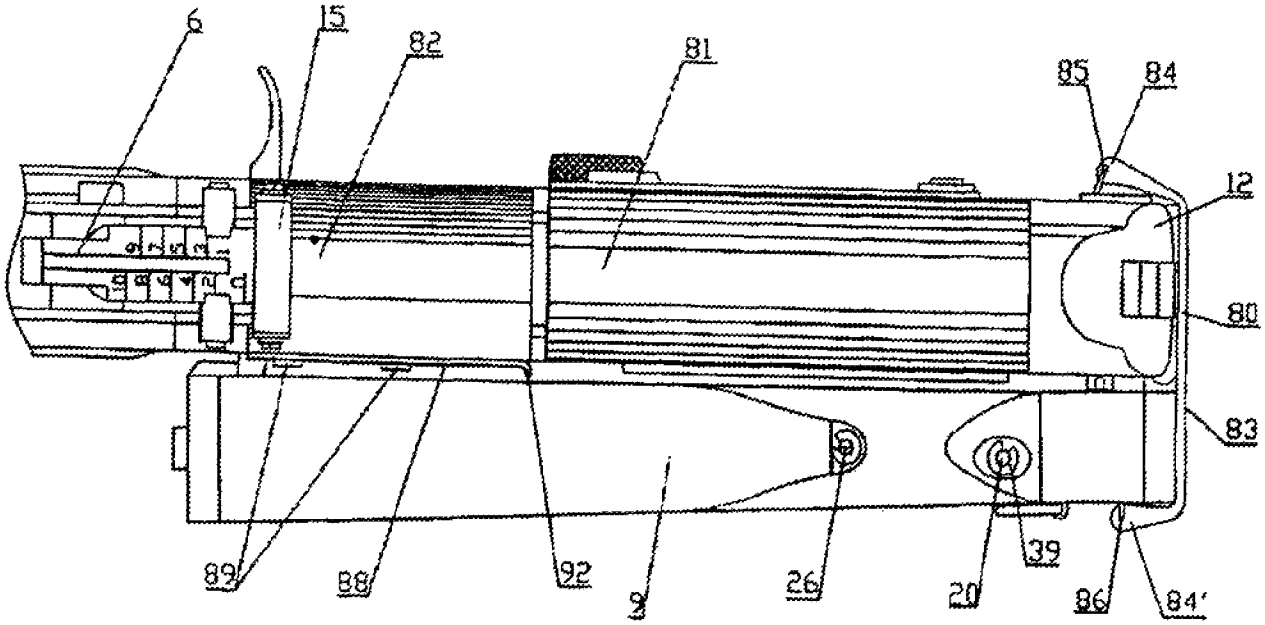
Figure 25A:
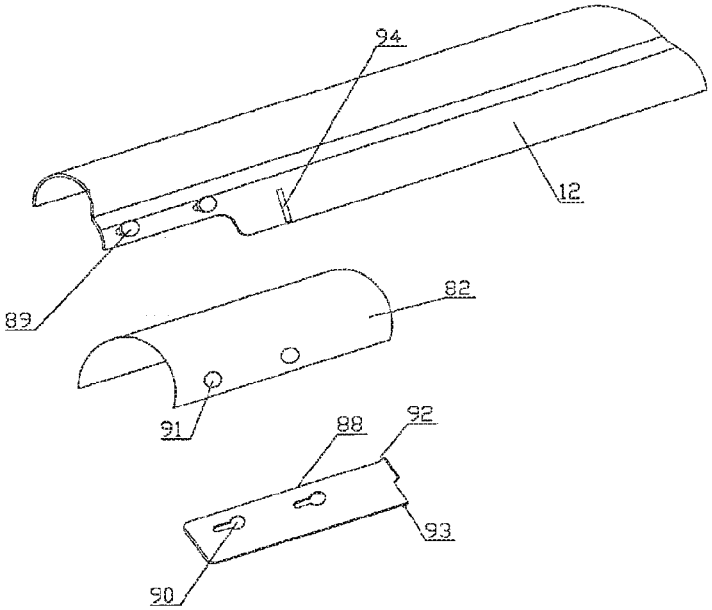
FIGS. 25*a*, 25*b* and 25*c* show the gas shield on the breech lid: a) in the disassembled state, b) in the assembled state, front view, and c) on the weapon, left-side view, according to the first and the second embodiments.
Figure 25B:
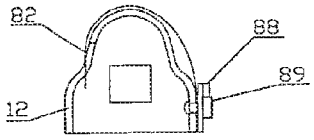
Figure 25C:
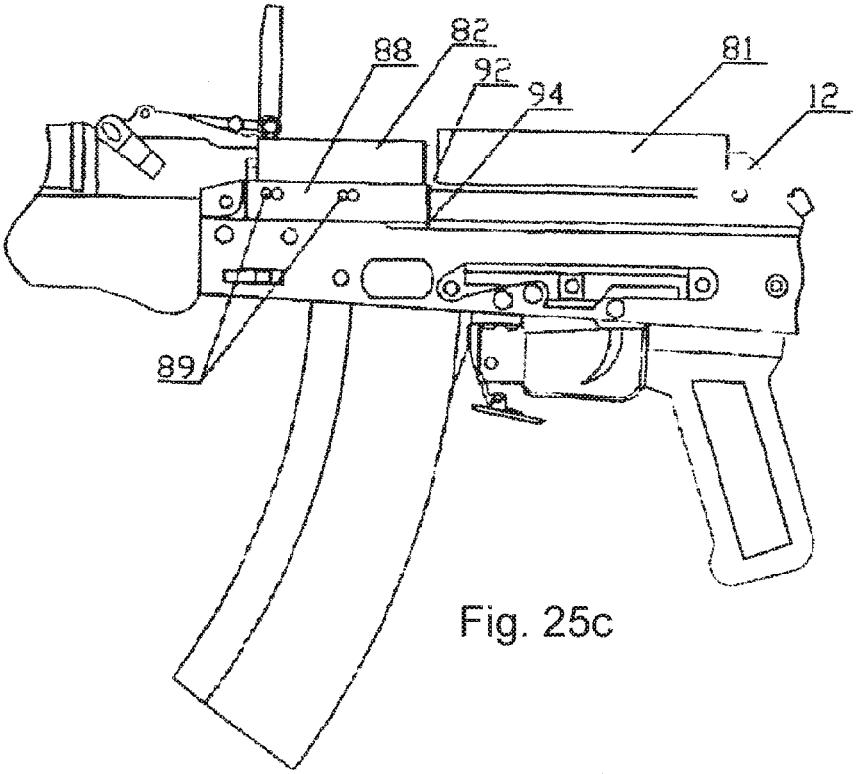
Figure 26:
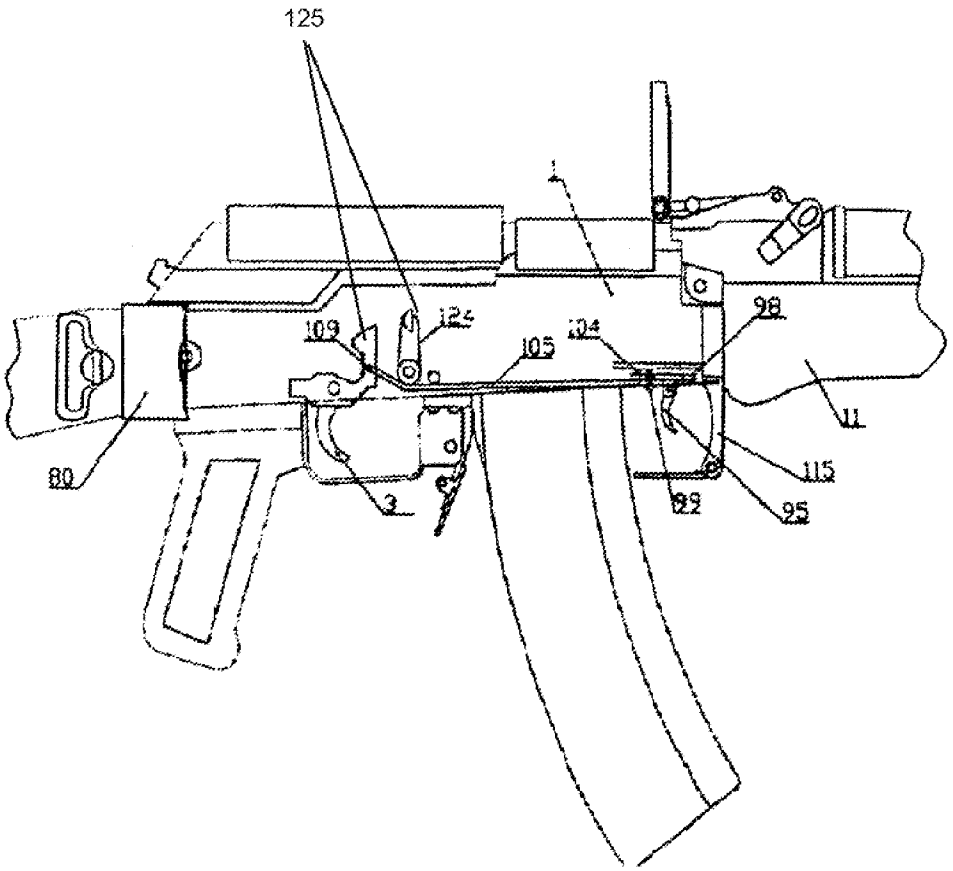
FIG. 26 shows a general view diagram of the automatic weapon (partial section, not all the parts of the TM are shown) with the combined system of use, according to the second embodiment, right-side view.
Figure 27:
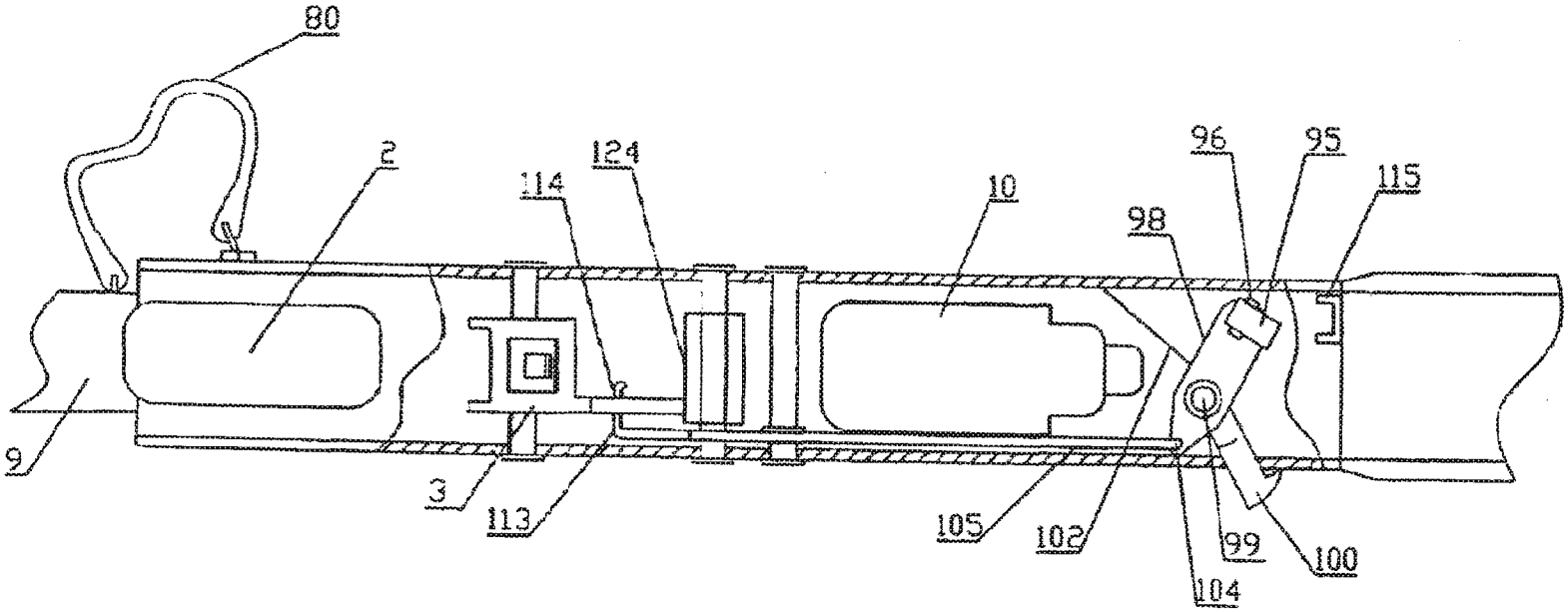
FIG. 27 shows a general view of the automatic weapon with the combined system of use (partial section, not all the parts of the TM are shown), bottom view, according to the second embodiment.
Figure 28:
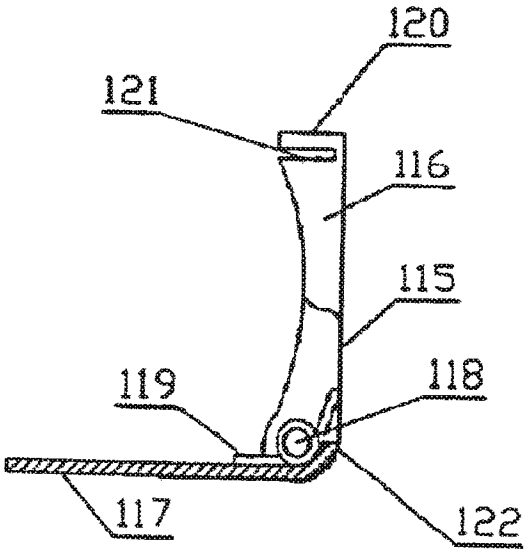
FIG. 28 shows the trigger staple for the additional trigger, right-side view, according to the first and the second embodiments.
Figure 29D:
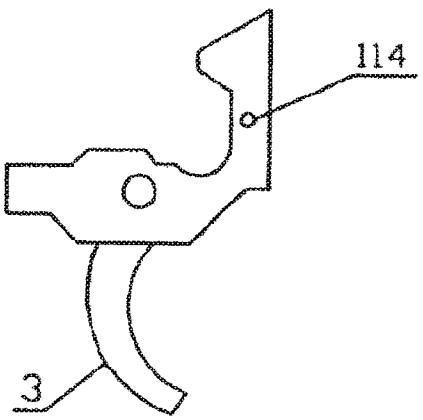
FIGS. 29*a*, 29*b*, 29*c* and 29*d* show: a) the additional trigger (right-side view, in a cross-section), b) the post for the additional trigger (right-side view, in a cross-section), c) the lever, bottom view, d) the weapon main trigger with an additional hole for the draw bar, right-side view, according to the second embodiment.
Figure 29A:
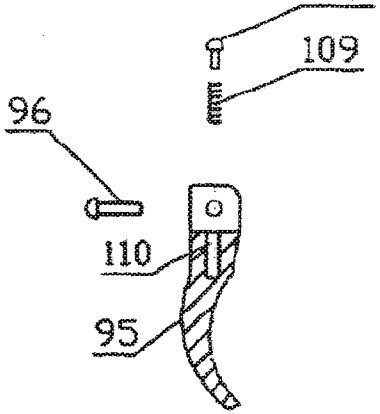
Figure 29B:
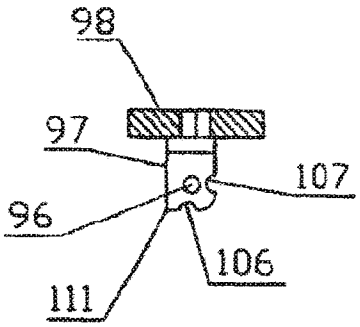
Figure 29C:
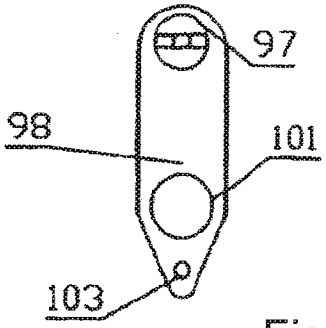
Figure 30A:
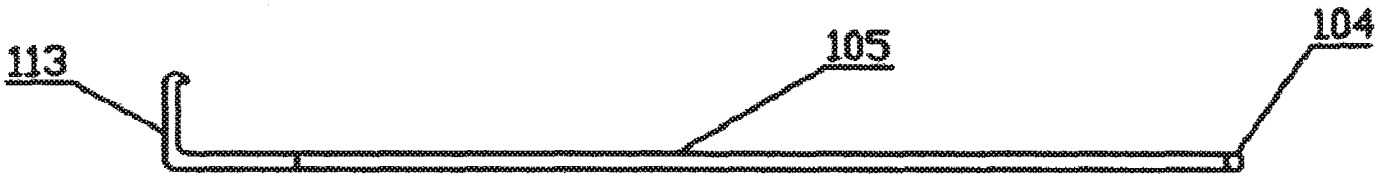
FIGS. 30*a* and 30*b* show the draw bar: a) bottom view, b) right-side view, according to the second embodiment.
Figure 30B:
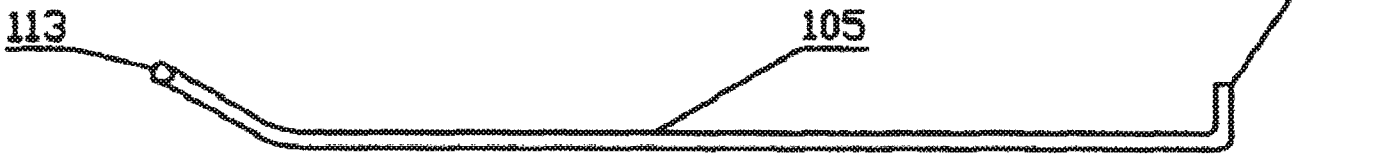
Figure 31B:
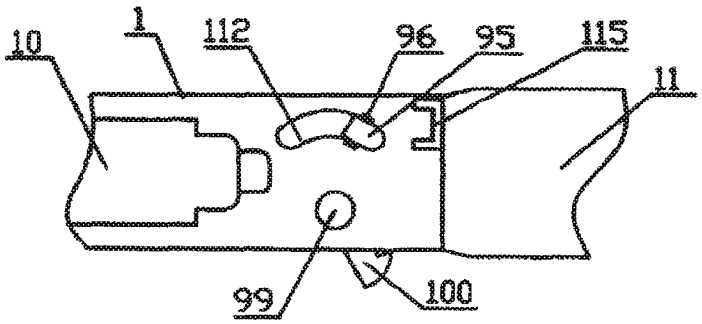
FIGS. 31*a*, 31*b* and 31*c* show a portion of the breech for the automatic weapon with the combined system of use: a) with the sector opening and the additional trigger folded into the horizontal position, bottom view, b) with the sector opening and the additional trigger put into the vertical position, bottom view, c) with the additional trigger in the horizontal position (inactivated state) with an under-barrel grenade launcher mounted onto the weapon and with a removed staple of the additional trigger, right-side view, according to the second embodiment.
Figure 31A:
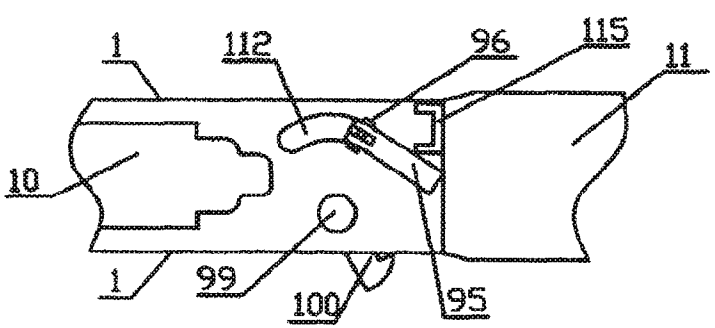
Figure 31C:
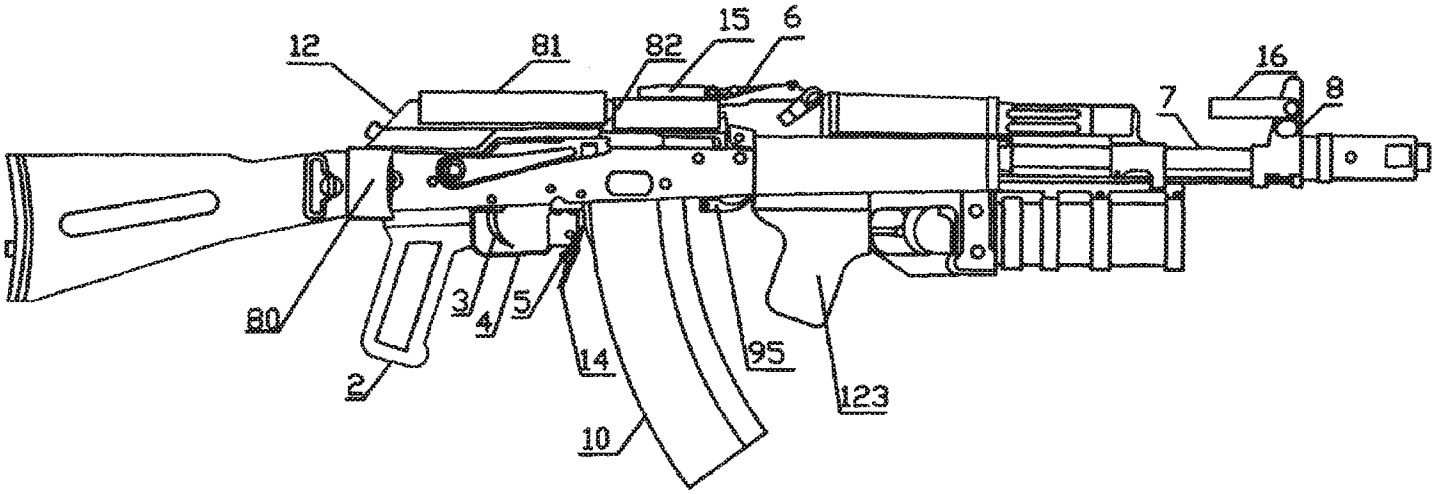

The procedure of assembling and turning the rotatable post of the additional foresight (16) is similar to the assembly and turns to a necessary position of the aperture sight (15). The bracket (71) of the additional foresight (FIG. 22) is made of a soft steel that is plastically deformable. It is made as a single piece having a pad (74) for the purpose of attaching it to the side of the staple (69) with rivets (75) and a bend (76) on which the additional foresight (70) and an adjuster (77) of foresight position, the adjuster is provided with a hole (78) having the size corresponding to the diameter of the standard knockout bar (79) of the weapon. In order to adjust a position of the foresight (70), the end of the knockout bar is put into the hole (78) and, by deforming the bend (76), install the foresight to a required position when ranging fire.

Figure 4:
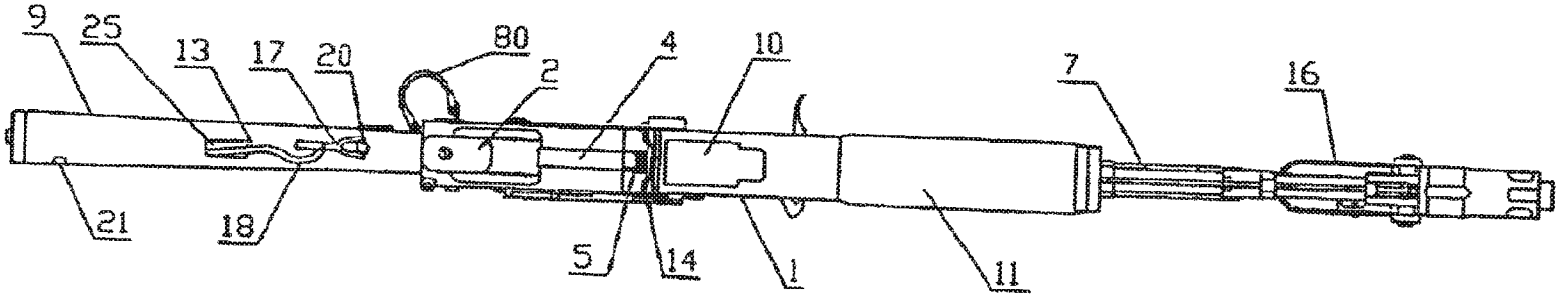
FIG. 4 shows a general view of the automatic weapon with the combined system of use, with the unfolded butt and the additional devices in the inactivated state, according to the first embodiment, bottom view.
Figure 5:
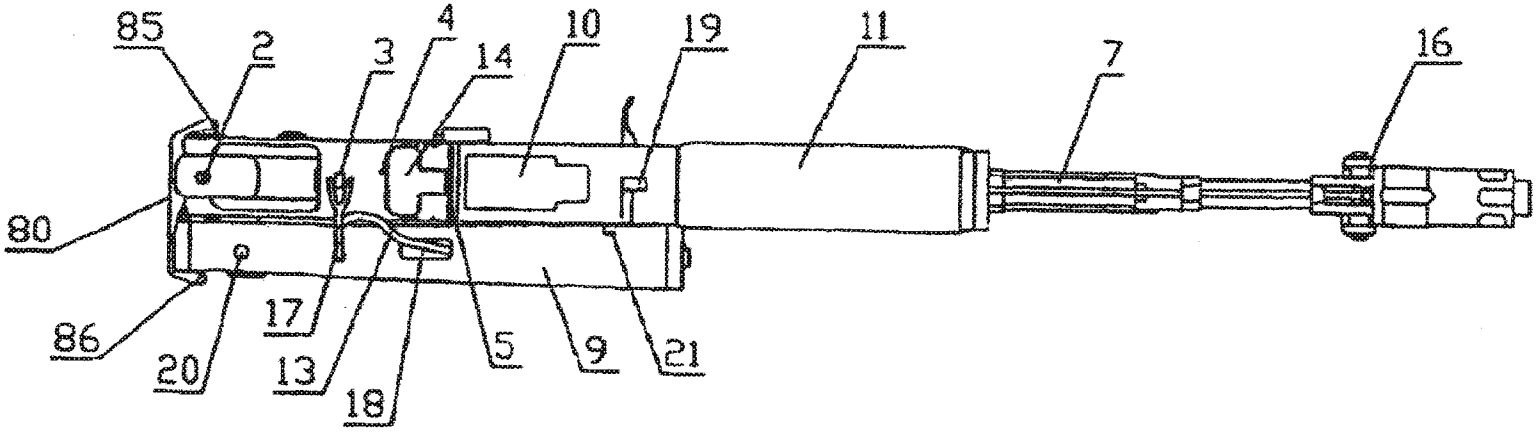
FIG. 5 shows a general view of the automatic weapon with the combined system of use, with the folded butt and the activated additional devices, according to the first embodiment, bottom view.
Figure 6:
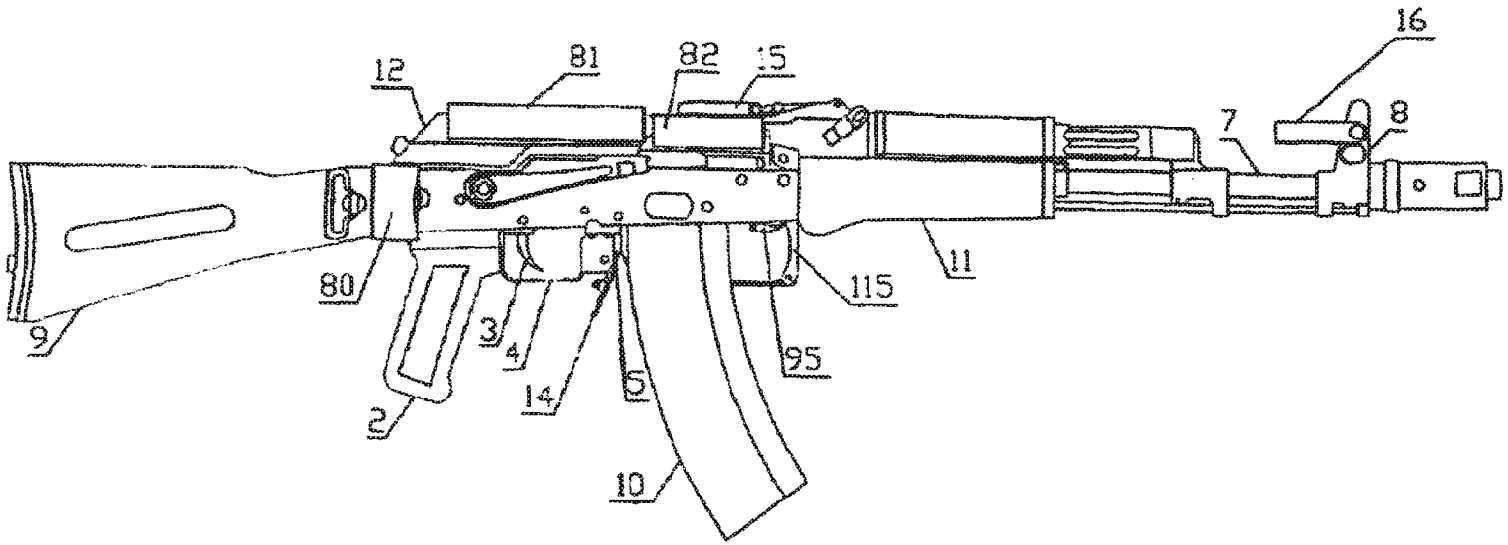
FIG. 6 shows a general view of the automatic weapon with the combined system of use, with the butt unfolded into the fight position and the inactivated additional devices, the second embodiment, right-side view.
Figure 7:
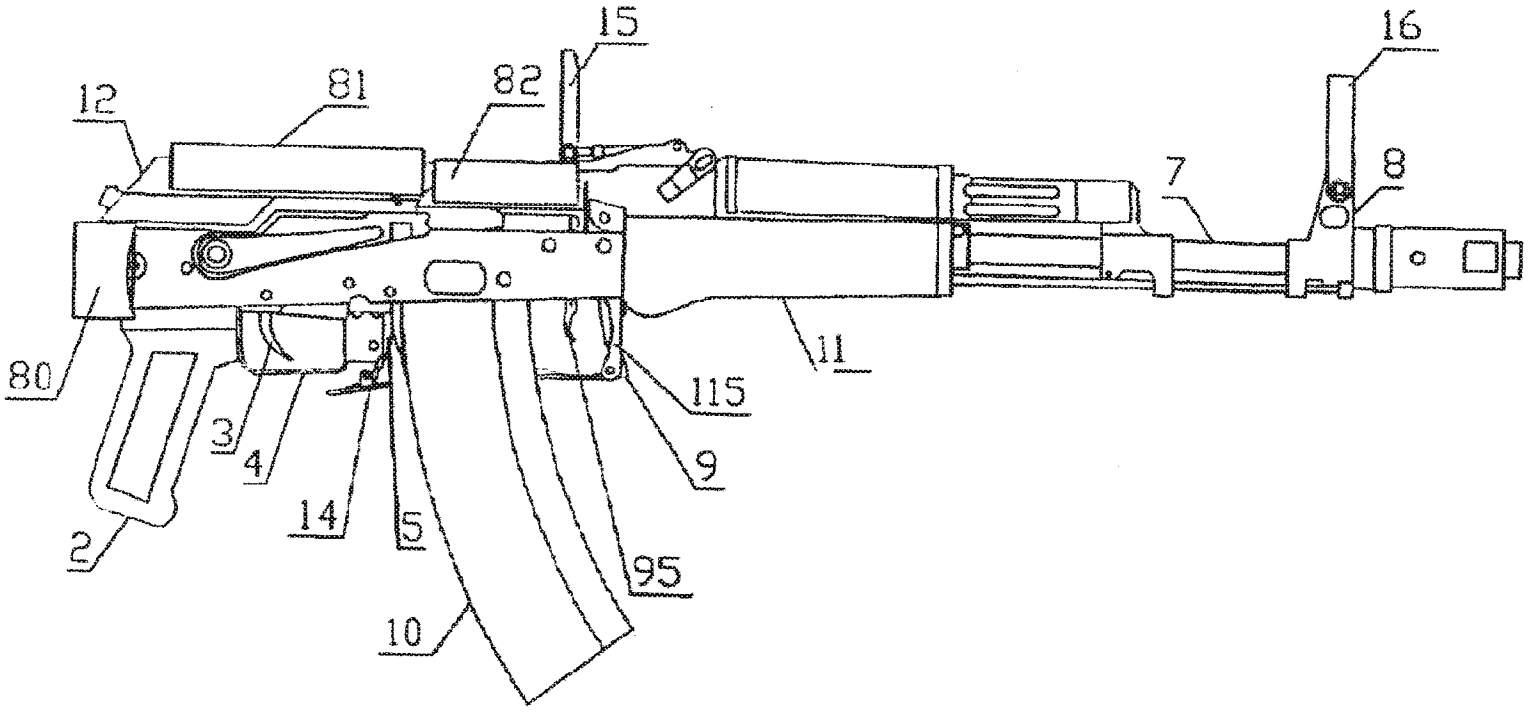
FIG. 7 shows a general view of the automatic weapon with the combined system of use, with the folded butt and the activated additional devices, the second embodiment, right-side view.
Figure 8:
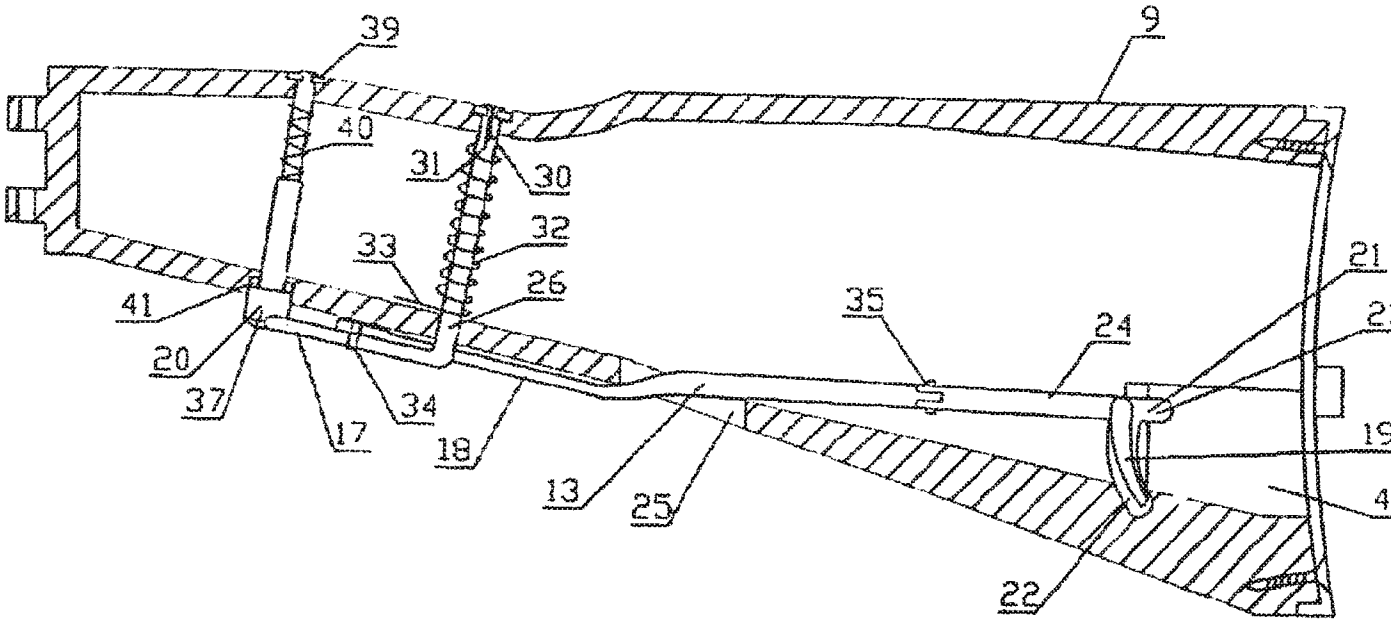
FIG. 8 shows the butt with the additional trigger, the draw bar, the rotatable fork, the fork retainer and the trigger stop, according to the first embodiment, in a cross-section, left-side view, in the inactivated state.
Figure 9:
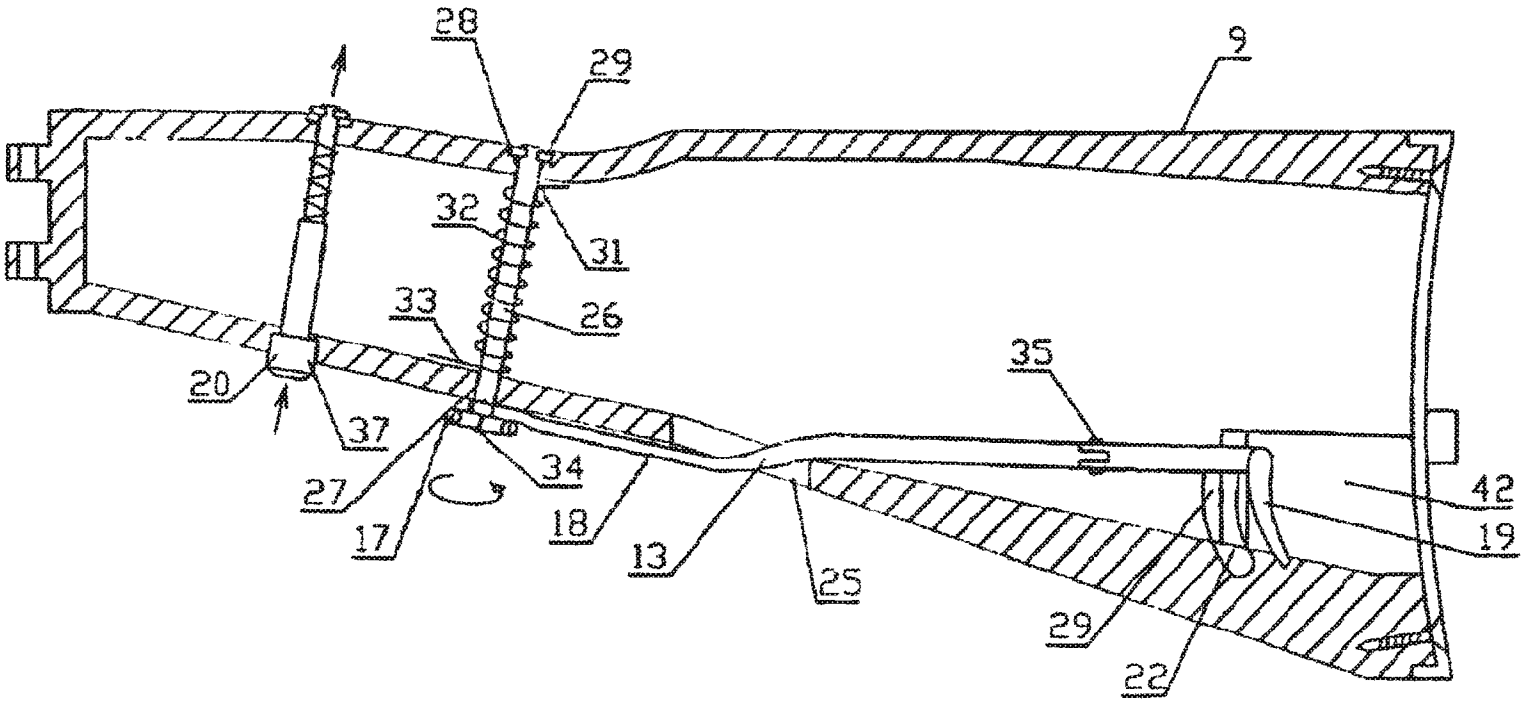
FIG. 9 shows the butt with the additional devices, according to the first embodiment, left-side view, in a cross-section, in the activated state.
Figure 10:
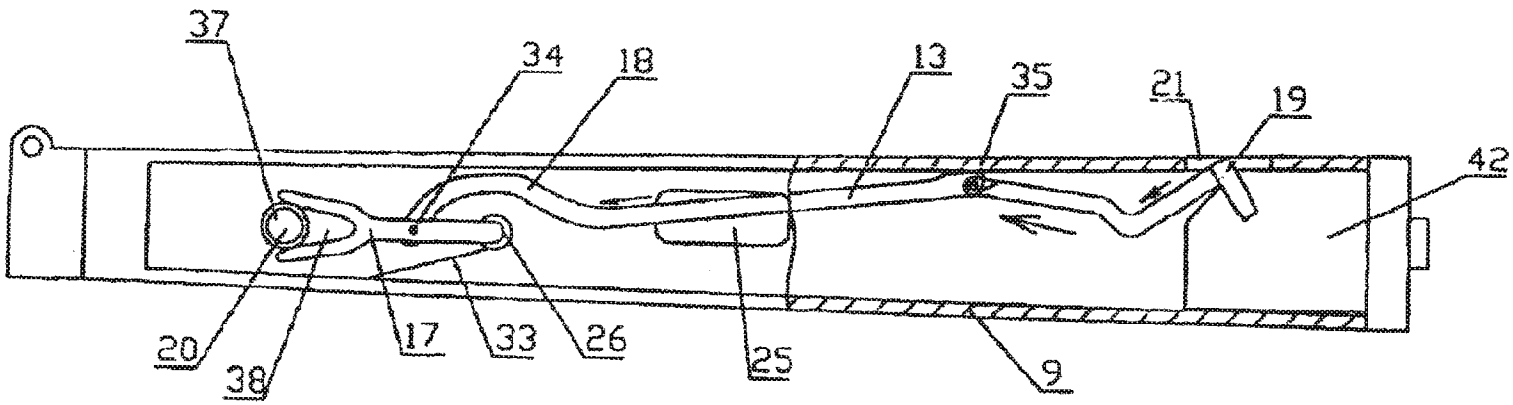
FIG. 10 shows the butt with the additional devices according to the first embodiment in the inactivated state, in a cross-section, bottom view.
Figure 11:
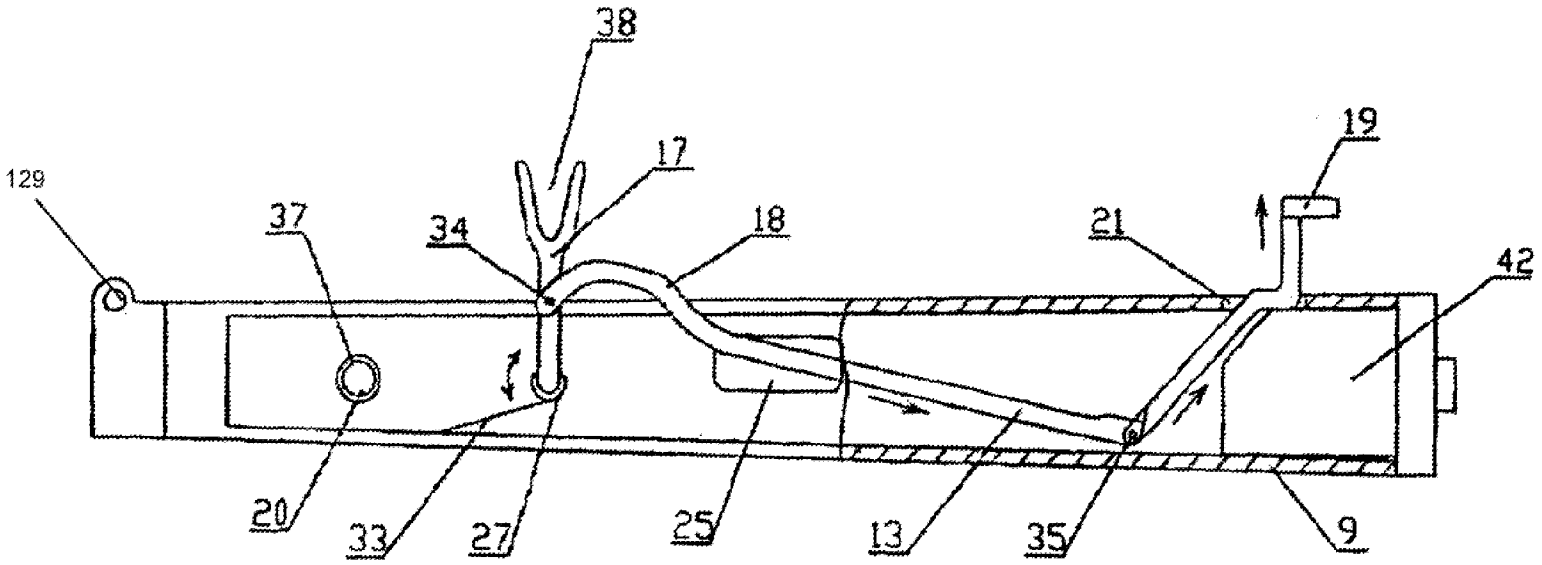
FIG. 11 shows the butt with the additional devices according to the first embodiment, in the activated state, in a cross-section, bottom view.

For the purpose of improving the comfort of using the weapon according to the "bullpup" system, the weapon is also provided with a rubber shock absorber (80) (FIGS. 1, 2, 3, 4, 5, 24 *a, b*) on the back plate of the breech, a cover (81) on the breech lid and a gas shield (82). The shock absorber (80) (FIGS. 2; 3; 4; 5; 24 *a, b*) is made as a flat elastic plate (83) with eye ends (84, 84'). Butt plates (85, 86) are inserted in the eye ends, one of them (85) is secured in the pin of the butt catch, and the second one is secured in the end of the butt, near its hinge. The middle portion of the plate (83) is wider than its ends, and, when the butt is folded, it completely covers the back plate of the breech and slightly hangs over the upper portion of the handle (2). This makes the sharp angles of the back plate smoother, and its rest against the shoulder becomes more comfort. When the butt is unfolded, the shock absorber folds in the ring shape on the right side of the weapon, thus not interfering with shooting in the "classic" version (FIG. 4).

The cover (81) (FIGS. 1, 2, 3, 6, 7, 24 *a, b*) on the breech lid (12) is made of foamed polyethylene or another similar material in the shape of half a pipe and is attached to the lid with the use of double-sided scotch tape (87) placed on the lid. When a cheek rests on the cover (81) during aiming, the aperture sight (50) and the additional foresight (70) are on the same axis as a rifleman eye, thus ensuring shooting accuracy. Also, the cover eliminates discomfort relating to temperature influence and striking loads during shooting.

The gas shield (82) (FIGS. 1, 2, 3, 6, 7, 24*a*, 24*b*, 24*c*, 25*a*, 25*b*, 25*c*) is a film of polyimide or another material having similar mechanical properties, which is formed as a half a pipe, which one end is attached to the upper left-side portion of the lid (12) on the barrel side with the use of a clamping plate (88) secured by T-shaped rivets (89) in pear-shaped holes (90) through holes (91), and the second end loosely hangs on the right side of the lid, partially covering the window for discharging cases, but not interfering with cocking by the handle of the bolt frame. The clamping plate (88), which is made of spring steel, has, on its right-side end, a support (92) and a hitch (93) that locks the clamping plate in the slot (94) of the lid (12).

In order to mount the gas shield (82) onto the lid (12), it is put with its holes (91) onto the T-shaped rivets (89), so as it covers the lid (12) from above, then the clamping plate (88) is put with its pear-shaped holes (90) onto the rivets (89), and the plate is moved to the right along the guides of the holes (90), simultaneously slightly raising the hitch (93) by the support (92) until the hitch comes into the slot (94) of the lid (12).

As a result, the gas shield is securely locked on the lid. In order to change the gas shield, the above operations are carried out in the reverse order.

During shooting, empty cases, which are discharged through the breech window, toss up the free end of the gas shield (82), it deforms, thus making the way for a discharged case, and returns back due to elasticity of the film material. This throws away gases from the cartridge chamber and discharged empty cases in the right-downward direction, which improves comfort of shooting in the "bullpup" position. Further, the gas shield helps to lower dirt accumulation in the cartridge chamber when shooting in dusty conditions. According to the first embodiment, the automatic weapon with the combined trigger works as follows: all the additional devices are in the inactivated state in the transportation position. Meanwhile, the weapon is in the "classic" state with the butt folded and allows to shoot with the use of hands to short distances.

In order to put the weapon into the firing state with the unfolded butt, the latter is unfolded and locked in the firing position. The weapon system turns out to be in "classic" firing state, allowing to aim and shoot with the butt and the standard sight and provides for using the butt during a hand-to-hand fight. In this state a magazine may be changed by one hand, by pressing with a finger of the other hand, which grips the handle (2), on projecting edges (47) or (47') of the rotatable pad (14) of the magazine catch (5). The magazine may be changed by one hand in the transportation position also.

Shooting in the "classic" version is as usual, the butt rests against the shoulder. In order to put the weapon in the "bullpup" position, it is necessary, when the butt is unfolded, to press by the right hand on the head (37) of the retainer (20). After being released, the fork (17), rotates, under the action of the spring (32), perpendicularly to the left side of the butt, meanwhile pushing the draw bar (18) and the additional trigger (19). The trigger (19), while interacting with the stop (42), comes out of the hole (21) and goes to the groove (23), raising over the side surface of the butt by 1.5-2.5 centimeters.

When installing the butt into the transportation position, the groove (38) of the fork (17) engages the main trigger (3), and the additional trigger (19) is installed ahead of the magazine (10) at a distance app. 2 centimeters.

At the same time, when folding the butt (9), the rubber shock absorber (80) is pulled over the back plate of the breech (1) and the butt hinge between the butt plates (85) and (86).

In order to activate the aperture sight, the ends of the staple (49) of the aperture sight (15) (FIG. 18*d*) are pressed, thus disconnecting the couplings at the ends of the staple (49) with the locking washers (51, 51'). The staple (49) is rotated at the cylindrical portions (53, 53') of the half-pins (48, 48') by 90° upwards until the protrusions (59) of the washers (51, 51) engage the grooves (57, 57') in the staple ends. As a result, the aperture sight (15) is installed in the vertical position, being firmly locked therein. Vertical adjustments for distance are made by the clip of the sight block (6).

In order to activate the rotatable post of the additional foresight (16), similarly to the aperture sight, the ends of the staple (69) are pressed, thus disengaging the grooves (73) from the protrusions (68) of the locking washers (66, 66'). The staple (69) is rotated on the cylindrical portion of the pin (60) by 90° until coupling teeth are engaged. As a result, the rotatable post (16) is firmly locked in the vertical position.

Meanwhile, the additional foresight (70) is installed in parallel with the elevation of the aperture sight, corresponding to the minimum distance, namely, 100 meters.

In order to adjust the foresight, its position is changed by changing the bend deformation (76) of the bracket (71) with the use of the knockout bar (79), after inserting its end into the hole (78) of the adjuster (79).

Activation of the additional devices from the "classic" system to the "bullpup" system takes 6-10 seconds.

In order to shoot from the "bullpup" position, a rifleman loads the weapon, takes the weapon by his right hand by the magazine, while resting the external surface of the hand between the thumb and the index finger against the pad (14) of the magazine catch. Now, the pad (14) rotates into the horizontal position parallel to the surface of contact with the rifleman's hand, thus ensuring comfort grip of the weapon by the magazine.

The rifleman holds the weapon by his left hand by the forearm (11), and rests his cheek against the cover (81). The rifleman's eye is now fixed on the optical axis between the aperture sight (50) and the foresight (70).

The back plate of the breech rests against the shoulder through the shock absorber (80). Now, the axis of the barrel (7) is in the middle of the shoulder rest.

The rifleman presses the additional trigger (19) with the index finger of the right hand. The force of the finger is transmitted to the main trigger (3) via the draw bar (18) and the fork (17), and the main trigger releases the weapon cock. A shot occurs.

During shooting, empty cases, which are discharged through the breech window, toss up the free end of the gas shield (82). It deforms, thus making the way for a discharged case, and returns back due to elasticity of the film material. This throws away gases from the cartridge chamber and discharged empty cases in the right-downward direction, which improves comfort of shooting in the "bullpup" position.

Shots in the "bullpup" system are fired in this position.

In order to put the additional devices into the inactivated position, the operations are performed in the reverse order.

According to the second embodiment, an additional trigger (95) (FIGS. 6, 7, 26, 27, 29, 31) is hingedly fixed by a pin (96) on a post (97) of a lever (98) secured with the possibility of rotating on a pin (99) (which serves as the pin for a catch (100) of the butt (9)) in a hole (101). The hole (101) also accommodates a spring (102) of the catch (100) of the butt. The end of the lever (98), which is opposite to the post (97), is provided with a hole (103), into which the end (104) of a draw bar (105) is inserted. The post (97) is made as a hinge and has two locking depressions: (106) for locking the additional trigger (95) vertically and (107) for fixing it horizontally. The additional trigger is locked in the depressions (106 and 107) by a retainer (108) and a spring (109) that are in a blind hole (110) of the trigger (95). Rotation of the additional trigger (95) on the pin (96) for more than 90 degrees is limited by a stop (111) of the post (97).

When the lever (98) is mounted within the cavity of the breech (1), the post (97) enters a sector opening (112) cut in the lower portion of the breech with the center on the pin axis (99). The draw bar (105) is passed along the left-side wall within the breech, and its second end (113) is inserted into an additional hole (114) of the main trigger (3).

A staple (115) serves as the staple against accidentally pulling the additional trigger (95). The staple (115) is formed by two bent plates (116, 117) hingedly connected by a pin (118) and moved apart by an angle of 90°-100° by a spring (119).

The end (120) of the plate (116) is inserted between the front lower surface of the breech (1) and the complementary portion of the forearm (11) into a groove (121). The plate (116) has U-shaped section and is provided with a stop (122) at its end having the pin (118), which stop limits rotation of the plate (117) on the pin (118). The plate (117) has the possibility of deflecting toward the lower surface of the breech (1). When the weapon is provided with an under-barrel grenade launcher (123), the staple (115) is removed from the weapon beforehand. In such a case the additional trigger (95) is moved to the horizontal position.

According to the second embodiment, the device works as follows:

In order to transfer the automatic weapon into the "bullpup" position, the butt (9) is folded into the transportation position, the shock absorber (80) is pulled over the back plate of the breech, and the sighting devices are activated (see the first embodiment). The additional trigger (95) is put from the horizontal position to the vertical position when the weapon safety catch is activated. Then the safety catch is inactivated, the weapon is cocked, and, while gripping the weapon by the right hand by the magazine, resting the shock absorber against the shoulder, and gripping the forearm by the left hand, the rifleman can aim and fire a shot by pressing the additional trigger with his index finger of the right hand.

When the additional trigger (95) is pulled, the lever (98) rotates in the sector opening (112) on the pin (99), thus pulling the draw bar (105) by the end (104) toward the forearm. The draw bar (105) rotates the trigger (3) with the end (113) secured in the hole (114) of the trigger (3), thus releasing the cock (124) of the weapon. A shot is fired. After the additional trigger (95) is released, it is returned by the lever (98) to the initial position in the sector opening (112) under the action of the main spring of the main trigger (3).

In order to fold the additional trigger (95) into the inactivated horizontal position, the rifleman presses on its back portion, the retainer (108) leaves the depression (106); the trigger rotates forward on the pin (96) to the horizontal position and is fixed by the retainer (108) in the depression (107). Before mounting an under-barrel grenade launcher onto the automatic weapon, the trigger (95) must be put into the horizontal position. The trigger can be moved into the vertical position after activation of the weapon safety catch.

What is claimed is:

1. An automatic weapon with a combined system of use, comprising:

a breech, a trigger mechanism, a locking mechanism, a gas outlet mechanism, a folding butt with retainers for a fight position and a transportation position, a barrel with a sight block, a sight bar and a foresight base, a magazine, a magazine catch, and a fire control handle, wherein the butt is hollow and comprises an additional trigger mechanism, wherein said additional trigger mechanism comprises:

an additional trigger, a draw bar, and a rotatable fork, said additional trigger, said draw bar, and said rotatable fork being interconnected hingedly, and being locked by a retainer in the transportation position so as to not protrude beyond a side surface of the butt, and wherein, in the activated fight position, when a fork groove is released from said retainer, said additional trigger, said draw bar, and said rotatable fork set perpendicularly, under action of a spring, over a left surface of the butt in a position where the fork grips a weapon main trigger, said additional trigger projecting beyond said side surface of the butt by 1.5-2.5 centimeters, wherein, when the butt is folded into the transportation position, said additional trigger is under a breech end ahead of said magazine, wherein the sight bar and the foresight are provided, on pins with tooth couplings, with additional rotatable posts for an aperture sight and an additional foresight, wherein said additional rotatable posts are comprised of springy staples and are rotatable by 90 degrees with fixation on the tooth couplings under elastic action, wherein said additional foresight, as fixed on an inner side wall of a respective post, is comprised of a deformable steel, a bracket of said additional foresight being deformed by bending, wherein said magazine catch is provided, on a pin with a spring, with a rotatable pad being rotatable into a horizontal position and having side protrusions, wherein a rubber shock absorber, covering a breech back plate, is arranged on additional butt plates, and wherein a breech lid is provided with a cover comprised of a porous elastic material and with a gas shield formed by a springy heat-resistant film covering a portion of a case-discharging window and being secured to said breech lid by a springy plate with another retainer, said another retainer being provided with T-shaped rivets.

2. An automatic weapon with a combined system of use, comprising:

a breech, a trigger mechanism, a locking mechanism, a gas outlet mechanism, a folding butt with retainers for a fight position and a transportation position, a barrel with a sight block, a sight bar and a foresight base, a magazine, a magazine catch, a fire control handle, and a rotatable lever mounted in a front lower part of the breech, in front of the magazine in a sector opening on an axis of a butt catch, wherein said rotatable lever comprises a post, and an additional trigger with a means for fixing horizontal and vertical positions of said additional trigger hingedly mounted on said post, wherein the lever is connected to a main trigger by a draw bar passing through an inside of the breech along a left side, the additional trigger being protected by a removable additional trigger staple consisting of two hingedly connected parts moved apart by a spring;

wherein the sight bar and the foresight are provided, on pins with tooth couplings, with additional rotatable posts for an aperture sight and an additional foresight, wherein said additional rotatable posts are comprised of springy staples and are rotatable by 90 degrees with fixation on the tooth couplings under elastic action, wherein said additional foresight, as fixed on an inner side wall of a respective post, is comprised of a deformable steel, a bracket of said additional foresight being deformed by bending, wherein said magazine catch is provided, on a pin with a spring, with a rotatable pad being rotatable into a horizontal position and having side protrusions, wherein a rubber shock absorber, covering a breech back plate, is arranged on additional butt plates, and wherein a breech lid is provided with a cover comprised of a porous elastic material and with a gas shield formed by a springy heat-resistant film covering a portion of a case-discharging window and being secured to said breech lid by a springy plate with another retainer, said another retainer being provided with T-shaped rivets.

* * * * *